US012075959B2

(12) United States Patent
Kim et al.

(10) Patent No.: US 12,075,959 B2
(45) Date of Patent: Sep. 3, 2024

(54) DISHWASHER HAVING CONDENSING DUCT AND HEAT EXCHANGE PORTION

(71) Applicant: LG Electronics Inc., Seoul (KR)

(72) Inventors: Doo Hyun Kim, Seoul (KR); Seungyoun Kim, Seoul (KR); Hyung Man Park, Seoul (KR); Min Jae Jeong, Seoul (KR); Youngsoo Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 61 days.

(21) Appl. No.: 17/508,594

(22) Filed: Oct. 22, 2021

(65) Prior Publication Data

US 2022/0125275 A1 Apr. 28, 2022

(30) Foreign Application Priority Data

Oct. 22, 2020 (KR) ..... 10-2020-0137874

(51) Int. Cl.
*A47L 15/48* (2006.01)
*A47L 15/42* (2006.01)
*F28F 1/10* (2006.01)

(52) U.S. Cl.
CPC ..... *A47L 15/483* (2013.01); *A47L 15/4246* (2013.01); *A47L 15/486* (2013.01); *F28F 1/10* (2013.01); *A47L 15/4285* (2013.01)

(58) Field of Classification Search
CPC ..... A47L 15/488; A47L 15/486; A47L 15/483
See application file for complete search history.

(56) References Cited

U.S. PATENT DOCUMENTS

2010/0300499 A1* 12/2010 Han ..... A47L 15/483 134/172
2011/0120513 A1* 5/2011 Jerg ..... A47L 15/481 134/115 R (Continued)

FOREIGN PATENT DOCUMENTS

CN 204581198 U * 8/2015
CN 106562737 A * 4/2017

(Continued)

OTHER PUBLICATIONS

Extended European Search Report in European Appln. No. 21204242.8, dated Feb. 23, 2022, 9 pages.

*Primary Examiner* — Joseph L. Perrin
*Assistant Examiner* — Irina Graf
(74) *Attorney, Agent, or Firm* — Fish & Richardson P.C.

(57) ABSTRACT

A dishwasher includes a tub, a door, and a drying device configured to supply air to a washing space in the tub. The drying device includes a condensing duct disposed outside the tub, a cold air supply module that is disposed outside the tub and defines a heat exchange flow path part adjoining the condensing duct, and a fan configured to cause air flow in the condensing duct. The condensing duct includes an upstream portion communicating with the inlet port and extending above the inlet port and then downward, and a heat exchange portion connected to the upstream portion and extending downward to the heat exchange flow path part. A height of an upper end of the heat exchange flow path part is equal to or larger than a height of a lower end of the inlet port.

20 Claims, 19 Drawing Sheets

(56) References Cited

U.S. PATENT DOCUMENTS

| | | | | |
|---|---|---|---|---|
| 2012/0055519 | A1* | 3/2012 | Hong | A47L 15/481 134/107 |
| 2014/0223761 | A1* | 8/2014 | Lee | A47L 15/488 34/218 |
| 2017/0290489 | A1* | 10/2017 | Noriega | A47L 15/4293 |
| 2019/0350432 | A1* | 11/2019 | Kopera | A47L 15/486 |
| 2021/0100424 | A1* | 4/2021 | Tan | A47L 15/488 |

FOREIGN PATENT DOCUMENTS

| | | | | |
|---|---|---|---|---|
| CN | 108784606 | A | * | 11/2018 |
| CN | 108852241 | | | 11/2018 |
| DE | 29621351 | | | 2/1997 |
| EP | 1097669 | A2 | * | 5/2001 |
| EP | 3524129 | | | 8/2019 |
| EP | 3127463 | | | 9/2019 |
| EP | 3741286 | A1 | * | 11/2020 |
| GB | 2308431 | A | * | 6/1997 |
| WO | WO-2018233262 | A1 | * | 12/2018 |
| WO | WO2019141187 | | | 7/2019 |

* cited by examiner

DISHWASHER HAVING CONDENSING DUCT AND HEAT EXCHANGE PORTION

CROSS-REFERENCE TO RELATED APPLICATION

This application claims priority to and the benefit of Korean Patent Application No. 10-2020-0137874, filed on Oct. 22, 2020, the disclosure of which is incorporated herein by reference in its entirety.

BACKGROUND

1. Field of the Disclosure

The present disclosure relates to a dishwasher, and more particularly, to a dishwasher with improved drying efficiency and energy efficiency

2. Description of Related Art

A dishwasher is a household electrical appliance that sprays a washing liquid to washing targets such as dishes or cookware to remove foreign substances remaining on the washing targets.

The dishwasher generally includes a tub configured to provide a washing space, a rack disposed in the tub and configured to accommodate dishes and the like, a spray arm configured to spray a washing liquid to the rack, a sump configured to store the washing liquid, and a washing pump configured to supply the spray arm with the washing liquid stored in the sump.

In addition, the dishwasher may have a drying module. The drying module may remove moisture remaining on the dish (drying target) by supplying heated air into the tub (a washing chamber or a drying chamber).

The drying modules may be classified into an open-circulation drying module and a closed-circulation drying module. The open-circulation drying module may discharge moist air in the tub to the outside of the tub, heat outside air, and supply the heated air into the tub. In contrast, the closed-circulation drying module may discharge moist air in the tub to the outside of the tub, remove moisture from the discharged air, and then supply the tub with the air from which the moisture is removed.

The drying module may include a duct, a fan configured to allow air to flow in the duct, and a cooling module (e.g., a cold air supplying module) configured to adjoin the duct.

To improve drying efficiency and energy efficiency of the drying module, water needs to be prevented from being introduced into the duct, flow resistance of the duct needs to be reduced, and heat transfer efficiency of a cooling module needs to be improved.

A shape of the duct needs to be adjusted to prevent water from being introduced into the duct and to reduce the flow resistance of the duct. A position or the like of the cooling module needs to be adjusted to improve the heat transfer efficiency of the cooling module.

The related art associated with the shape of the duct of the drying module will be described below.

European Patent No. 3127463 relates to a dishwasher including a washing container and an air duct. The air duct includes an ascending duct section KA1 connected to an air outlet opening LA, and then a descending duct section KA2. A cross-sectional area of an upstream section (starting section) AA after the outlet opening in the ascending duct section is larger than a cross-sectional area of the outlet opening and a cross-sectional area of the descending duct section. Therefore, a flow velocity of air decreases in the ascending duct section. The upstream section has a gradient of a positive angle of 30 to 60 degrees with respect to a horizontal surface. The ascending duct section and the descending duct section has a bow piece shape starting with the outlet opening.

However, in the related art, the duct is severely bent by about 210 to 240 degrees. Therefore, a length of the ascending duct section and a length of the descending duct section increase, which greatly increases the flow resistance. In addition, since the cross-sectional area of the descending duct section is smaller than the cross-sectional area of the upstream section of the ascending duct section, the flow resistance may greatly increase.

In addition, the related art does not disclose the cooling module.

RELATED ART DOCUMENT

Patent Document (Patent Document 001) EP Patent No. 3127463

SUMMARY OF THE DISCLOSURE

An object of the present disclosure is to provide a dishwasher with improved drying efficiency and energy efficiency.

Another object of the present disclosure is to provide a dishwasher capable of improving drying performance, preventing proliferation of bacteria or mold in a condensing duct, and preventing a drying device from being broken down by water.

Still another object of the present disclosure is to provide a dishwasher capable of reducing a size thereof and improving an aesthetic appearance thereof.

Yet another object of the present disclosure is to provide a dishwasher capable of having a simplified configuration and reducing manufacturing and maintenance costs.

The objects of the present disclosure are not limited to the above-mentioned objects, and other objects and advantages of the present disclosure, which are not mentioned above, may be understood from the following descriptions and more clearly understood from the embodiment of the present disclosure. In addition, it can be easily understood that the objects and advantages of the present disclosure may be realized by means defined in the claims and a combination thereof.

To achieve the objects, the present disclosure provides a dishwasher 1 including a tub 12, a door 14, and a drying device 100.

The tub 12 may have a washing space 12S therein.

The door 14 may be disposed at a front side of the tub 12.

The door 14 may open or close the washing space 12S.

The drying device 100 may dry the washing space 12S.

The drying device 100 may include a condensing duct 1122, a cold air supply module 120, and a fan 130.

The condensing duct 1122 may communicate with an inlet port H1 formed in the tub 12.

The condensing duct 1122 may be disposed outside the tub 12.

The condensing duct 1122 may face an outer surface of the tub 12.

The cold air supply module 120 may be disposed outside the tub 12.

The cold air supply module 120 may adjoin the condensing duct 1122.

The cold air supply module 120 may include a heat exchange flow path part 126.

The fan 130 may allow the air in the condensing duct 1122 to flow.

The condensing duct 1122 may include an upstream portion 1122A and a heat exchange portion 1122B.

The upstream portion 1122A may communicate with the inlet port H1.

The upstream portion 1122A may be bent to ascend from the inlet port H1 and then descend.

The heat exchange portion 1122B may be connected to the upstream portion 1122A and extend downward.

The heat exchange portion 1122B may adjoin the heat exchange flow path part 126.

The heat exchange flow path part 126 may be disposed at one side of the inlet port H1 in the first direction which is a lateral direction of the condensing duct 1122.

A height of an upper end 126UE of the heat exchange flow path part 126 may be equal to or larger than a height of a lower end H1LE of the inlet port H1.

In the embodiment, a downstream end 126D of the heat exchange flow path part 126 may be opened toward a portion of the upstream portion 1122A, which faces the inlet port H1 or extends in a vertically upward direction or an inclined upward direction.

In the embodiment, a height of the upper end 126UE of the heat exchange flow path part 126 may be equal to or smaller than a height of an upper end H1UE of the inlet port H1.

In the embodiment, a cross-sectional area of a downstream end 1122A3D of the upstream portion 1122A may be larger than a cross-sectional area of the upstream portion 1122A at a height of an upper end H1UE of the inlet port H1.

In the embodiment, a width BD of a concave portion CP defined by the bent inner surface of the upstream portion 1122A in the first direction may gradually decrease or remain the same toward an upper end UP of the bent inner surface of the upstream portion 1122A along upward direction.

In the embodiment, the upstream portion 1122A may include an inflow portion 1122A1, an ascending duct portion 1122A2, and a descending duct portion 1122A3.

The inflow portion 1122A1 may face the inlet port H1.

The inflow portion 1122A1 may extend to the height of the upper end H1UE of the inlet port H1.

The inflow portion 1122A1 may be opened upward.

The ascending duct portion 1122A2 may extend from an upper end 1122A1D of the inflow portion 1122A1.

The ascending duct portion 1122A2 may extend in the vertically upward direction or an upward direction inclined toward one side in the first direction.

The descending duct portion 1122A3 may have an upstream end communicating with a downstream end of the ascending duct portion 1122A2.

The descending duct portion 1122A3 may extend in a vertically downward direction or a downward direction inclined toward one side in the first direction.

The descending duct portion 1122A3 may have a downstream end 1122A3D communicating with the heat exchange portion 1122B.

In the embodiment, the ascending duct portion 1122A2 may not extend in an upward direction inclined toward the other side in the first direction.

In the embodiment, the inflow portion 1122A1 may include a section AS in which a cross-sectional area of the inflow portion 1122A1 increases upward.

In the embodiment, in at least a part of the section AS, the inflow portion 1122A1 may be further expanded toward the other side in the first direction than the other end in the first direction of the inlet port H1.

In the embodiment, the heat exchange portion 1122B may extend from a downstream end 1122A3D of the upstream portion 1122A.

Gradients of two opposite surfaces in the first direction at the downstream end 1122A3D of the upstream portion 1122A may respectively correspond to gradients of two opposite surfaces in the first direction at an upstream end 1122BU of the heat exchange portion 1122B.

In the embodiment, the upstream portion 1122A may have one or more guides G1, G2 and G3 protruding in a second direction which intersects a direction in which the condensing duct 1122 extends.

The one or more guides G1, G2 and G3 may extend in a longitudinal direction of the upstream portion 1122A.

In the embodiment, the guide may be a vane.

In the embodiment, the guide may be provided in plural, and the plurality of the guides G1, G2 and G3 may be disposed to be spaced apart from one another at predetermined intervals on the upstream portion 1122A.

A distance HD1, HD2 or HD3 in the first direction from the heat exchange flow path part 126 to an upstream end GE1, GE2 or GE3 of the guide G1, G2 or G3 may increase as the guide is positioned at an upper side.

In the embodiment, the guide may have a slit SL.

In the embodiment, the slit SL may be inclined downwardly in a direction becoming closer to a center H1C of the inlet port H1.

In the embodiment, the guide may be provided in plural, and the plurality of the guides G1, G2 and G3 may be disposed to be spaced apart from one another at predetermined intervals on the upstream portion 1122A.

The slits SL1, SL2 and SL3 may be respectively formed in the plurality of guides G1, G2 and G3.

A distance HD4, HD5 or HD6 in the first direction from a center H1C of the inlet port H1 to the slit SL1, SL2 or SL3 may increase as the guide is positioned at an upper side.

In the embodiment, the slit SL1, SL2 or SL3, which is formed in the guide G1, G2, or G3 positioned at the lowest portion among the guides G1, G2, and G3, may be positioned in a vertically upward direction or in an upward direction inclined toward the other side in the first direction from an upper end UP of a bent inner surface of the upstream portion 1122A.

Advantageous Effect

According to the embodiment of the present disclosure, the first condensing duct 1122 may include the upstream portion 1122A communicating with the inlet port H1 and bent extending from the inlet port H1 to ascend and then descend. Therefore, even though the water in the tub 12 is introduced into the upstream portion 1122A through the inlet port H1, the introduced water cannot pass through the ascending duct portion 1122A2 because of the weight of the water. Therefore, it is possible to prevent the water from being introduced into the condensing duct 112. Therefore, it is possible to improve the drying performance, prevent the drying device 100 from being broken down by the water, and inhibit proliferation of bacteria or mold in the condensing duct 112. In addition, since the upstream portion 1122A is bent to ascend and then descend, the upstream portion 1122A may be connected to the heat exchange portion 1122B which is connected to the upstream portion 1122A and extends downward.

According to the embodiment of the present disclosure, the first condensing duct 1122 may include the heat exchange portion 1122B which is connected to the upstream portion 1122A, extends downward, and adjoins the heat exchange flow path part 126. Therefore, the water condensed in the heat exchange portion 1122B may fall or flow downward by gravity, such that the condensate water may be easily collected and quickly discharged to the outside. Thus, the drying efficiency may be improved. In addition, since the heat exchange portion 1122B extends downward, an optimal route in which the air flows downward from the inlet port H1 to the outlet port H2 disposed lower than the inlet port H1 may be provided to the drying duct 110. Therefore, when the drying duct 110 includes the heat exchange portion 1122B, the length of the drying duct 110 decreases, and the flow resistance is reduced, which makes it possible to improve the drying efficiency and energy efficiency.

According to the embodiment of the present disclosure, the heat exchange flow path part 126 may be disposed at one side in the first direction of the inlet port H1. Therefore, a first direction extension component which the upstream portion 1122A may have to connect the inlet port H1 and the heat exchange portion 1122B adjoining the heat exchange flow path part 126 may be repeatedly used as the first direction extension component for allowing the upstream portion 1122A to be bent to ascend and then descend. Therefore, the length of the upstream portion 1122A may decrease. Therefore, the distance by which the air introduced into the upstream portion 1122A through the inlet port H1 flows to the heat exchange portion 1122B adjoining the heat exchange flow path part 126 may decrease. Therefore, the air flowing out of the tub 12 through the inlet port H1 may reach the heat exchange portion 1122B in a high-temperature state, which makes it possible to improve the heat transfer efficiency and reduce the flow resistance because the flow distance decreases. In addition, when a temperature of air is high, the amount of saturated water vapor significantly decreases as the temperature decreases. Therefore, a large amount of condensate water may be produced by cooling the high-temperature air in the heat exchange portion 1122B. Therefore, the drying efficiency and energy efficiency may be improved.

According to the embodiment of the present disclosure, a height of an upper end 126UE of the heat exchange flow path part 126 may be equal to or larger than a height of a lower end H1LE of the inlet port H1. Therefore, a downward extension component (descending duct portion) of the upstream portion 1122A may have a comparatively short length to connect the upper end (downstream end) of the upward extension component (ascending duct portion) and the upstream end 1122BU of the heat exchange portion 1122B adjoining the heat exchange flow path part 126. Therefore, the length of the upstream portion 1122A may decrease. Therefore, the distance by which the air introduced into the upstream portion 1122A through the inlet port H1 flows to the heat exchange portion 1122B adjoining the heat exchange flow path part 126 may decrease. Therefore, the air flowing out of the tub 12 through the inlet port H1 may reach the heat exchange portion 1122B in a high-temperature state, which makes it possible to improve the heat transfer efficiency and reduce the flow resistance because the flow distance decreases. In addition, when a temperature of air is high, the amount of saturated water vapor significantly decreases as the temperature decreases. Therefore, a large amount of condensate water may be produced by cooling the high-temperature air in the heat exchange portion 1122B. Therefore, the drying efficiency and energy efficiency may be improved.

In addition, the heat exchange flow path part 126 may be expanded to the height at which the inlet port H1 is formed. In particular, when the inlet port H1 is formed in the upper portion of one sidewall 12R, the heat exchange flow path part 126 may be expanded to the upper portion of one sidewall 12R. Therefore, the contact area between the heat exchange flow path part 126 and the heat exchange portion 1122B may increase, thereby improving the heat transfer efficiency. Therefore, the drying efficiency and energy efficiency may be improved.

In addition, the downstream end 126D of the heat exchange flow path part 126 may face the upstream portion 1122A. Therefore, when the downstream end 126D of the heat exchange flow path part 126 is opened toward the upstream portion 1122A, the cold air in the heat exchange flow path part 126 may be discharged toward the upstream portion 1122A. Therefore, as the upstream portion 1122A comes into contact with the cold air, the condensate water may be produced in the upstream portion 1122A and discharged to the outside. Therefore, the drying performance may be improved.

According to the embodiment of the present disclosure, the downstream end 126D of the heat exchange flow path part 126 may be opened toward the portion of the upstream portion, which faces the inlet port H1 or extends in the vertically upward direction or the inclined upward direction. Therefore, the cold air flowing along the heat exchange flow path part 126 may cool not only the air flowing in the heat exchange portion 1122B, but also the air in the inflow portion 1122A1 or the ascending duct portion 1122A2. Therefore, the condensate water may be produced in the inflow portion 1122A1 or the ascending duct portion 1122A2 as well as the heat exchange portion 1122B and then discharged to the outside, which makes it possible to improve the drying performance.

According to the embodiment of the present disclosure, the height of the upper end 126UE of the heat exchange flow path part 126 may be equal to or smaller than the height of the upper end H1UE of the inlet port H1. Therefore, the height (vertical length) of the ascending duct portion 1122A2 may decrease. Therefore, the length of the upstream portion 1122A may decrease, and the drying efficiency and energy efficiency may be improved. In addition, the upstream portion 1122A need not protrude upward from the upper end of the tub 12 even though the inlet port H1 is formed in the upper portion of one sidewall 12R. Therefore, it is possible to miniaturize the dishwasher and improve the aesthetic appearance of the dishwasher. In addition, even though the height (vertical length) of the ascending duct portion 1122A2 is small, the water may not be introduced into the upstream portion 1122A, the flow resistance may be reduced, and the flow direction of the air in the descending duct portion 1122A3 may be stably changed to the extension direction of the heat exchange portion 1122B.

According to the embodiment of the present disclosure, the height of the upper end 126UE of the heat exchange flow path part 126 may correspond to the height of the upper end H1UE of the inlet port H1. Therefore, the heat exchange flow path part 126 may be expanded to the height of the upper end H1UE of the inlet port H1. Therefore, the contact area between the heat exchange flow path part 126 and the heat exchange portion 1122B may increase, thereby improving the heat transfer efficiency. Therefore, the drying efficiency and energy efficiency may be improved.

In addition, a length by which the downstream end 126D of the heat exchange flow path part 126 vertically faces the upstream portion 1122A may increase. For example, the downstream end 126D of the heat exchange flow path part 126 may face the upstream portion 1122A vertically to the height of the upper end H1UE of the inlet port H1. Therefore, since the cold air discharged from the downstream end 126D of the heat exchange flow path part 126 may be in contact with the upstream portion 1122A vertically, the temperature in the upstream portion 1122A may be effectively decreased, and a large amount of condensate water may be produced and discharged to the outside. Therefore, the drying performance may be improved.

According to the embodiment of the present disclosure, a cross-sectional area of a downstream end 1122A3D of the upstream portion 1122A may be larger than a cross-sectional area of the upstream portion 1122A at a height of an upper end H1UE of the inlet port H1 (a cross-sectional area of an upstream end of an inflow portion). Therefore, even though the flow direction of the air in the upstream portion 1122A is considerably changed, the flow resistance may be reduced, thereby improving the drying efficiency and energy efficiency. In addition, since the cross-sectional area of the downstream end 1122A3D of the upstream portion 1122A is large, a cross-sectional area of the heat exchange flow path part 126 communicating with the downstream end 1122A3D of the upstream portion 1122A may also be large. Therefore, the contact area between the heat exchange flow path part 126 and the heat exchange portion 1122B may increase, thereby improving the heat transfer efficiency.

According to the embodiment of the present disclosure, a width BD of the concave portion CP defined by the bent inner surface of the upstream portion 1122A in the first direction may gradually decrease or remain the same toward an upper end UP of the bent inner surface of the upstream portion 1122A along upward direction. Therefore, based on the concave portion CP defined by the bent inner surface of the upstream portion 1122A, the ascending duct portion 1122A2 disposed at a side of the inlet port H1 and the descending duct portion 1122A3 disposed at a side of the heat exchange flow path part 126 may adjoin to or communicate with each other by becoming closer to each other without becoming distant in the middle. Therefore, a total width in the first direction of the upstream portion 1122A may decrease, and vertical lengths of the ascending duct portion 1122A2 and the descending duct portion 1122A3 may decrease. Therefore, since the length of the upstream portion 1122A decreases, a distance by which the air introduced into the upstream portion 1122A through the inlet port H1 flows to the heat exchange portion 1122B adjoining the heat exchange flow path part 126 may decrease. Therefore, the air flowing out of the tub 12 through the inlet port H1 may reach the heat exchange portion 1122B in a high-temperature state, which makes it possible to improve the heat transfer efficiency and reduce the flow resistance because the flow distance decreases. In addition, when a temperature of air is high, the amount of saturated water vapor significantly decreases as the temperature decreases. Therefore, a large amount of condensate water may be produced by cooling the high-temperature air in the heat exchange portion 1122B. Therefore, the drying efficiency and energy efficiency may be improved. In addition, when the width BD in the first direction of the concave portion CP defined by the bent inner surface of the upstream portion 1122A gradually decreases along upward direction, the flow direction of the air along the bent inner surface may be slowly changed, thereby reducing the flow resistance.

According to the embodiment of the present disclosure, the upstream portion 1122A includes: the inflow portion 1122A1 facing the inlet port H1, extending to the height of the upper end H1UE of the inlet port H1, and opened upward; the ascending duct portion 1122A2 extending from the upper end (downstream end 1122A1D) of the inflow portion 1122A1 and extending in the vertically upward direction or the upward direction inclined toward one side in the first direction; and the descending duct portion 1122A3 having the upstream end communicating with the downstream end of the ascending duct portion 1122A2, extending in the vertically downward direction or the downward direction inclined toward one side in the first direction, and having the downstream end 1122A3D communicating with the heat exchange portion 1122B. Therefore, it is possible to simply configure the upstream portion 1122A curvedly extending from the upstream end to allow the air to ascend and then descend therein. In addition, when the heat exchange flow path part 126 is disposed at one side in the first direction of the inlet port H1, the ascending duct portion 1122A2 and the descending duct portion 1122A3 may extend toward one side in the first direction, which is a direction approaching the heat exchange flow path part 126 in the first direction. Therefore, the length of the upstream portion 1122A for connecting the inlet port H1 and the heat exchange portion 1122B adjoining the heat exchange flow path part 126 may decrease. Therefore, the manufacturing and management costs may be reduced, and the drying efficiency and energy efficiency may be improved.

According to the embodiment of the present disclosure, the ascending duct portion 1122A2 may not extend in the upward direction inclined toward the other side in the first direction. Therefore, when the heat exchange flow path part 126 is disposed at one side in the first direction of the inlet port H1, the ascending duct portion 1122A2 and the descending duct portion 1122A3 may extend only toward one side in the first direction, which is a direction approaching the heat exchange flow path part 126 in the first direction. Therefore, the length of the upstream portion 1122A for connecting the inlet port H1 and the heat exchange portion 1122B adjoining the heat exchange flow path part 126 may decrease. Therefore, the drying efficiency and energy efficiency may be improved.

According to the embodiment of the present disclosure, the inflow portion 1122A1 may include a section AS in which the cross-sectional area increases upward. Therefore, even though a width in the second direction of the inflow portion 1122A1 is small, the flow direction of the air introduced into the inflow portion 1122A1 through the inlet port H1 may be easily changed from the second direction into a vertically upward direction or into an upward direction inclined toward one side in the first direction without great flow resistance. Therefore, the air in the inflow portion 1122A1 may stably flow to the ascending duct portion 1122A2 provided at the upper side of the inflow portion 1122A1. Therefore, the drying efficiency and energy efficiency may be improved.

According to the embodiment of the present disclosure, in at least a part of the section AS, the inflow portion 1122A1 may be further expanded toward the other side in the first direction than the other end in the first direction of the inlet port H1. Therefore, the width of the inflow portion 1122A1 increases, which makes it possible to reduce the flow resistance. Therefore, the drying efficiency and energy efficiency may be improved. In addition, when the heat exchange flow path part 126 is disposed at one side in the first direction of the inlet port H1, the inflow portion 1122A1 facing the inlet port H1 is expanded toward the other side in the first direction away from the heat exchange flow path part 126, and thus the heat exchange flow path part 126 may be expanded toward one side in the first direction to a point close to the inlet port H1. Therefore, the contact area between the heat exchange flow path part 126 and the heat exchange portion 1122B may increase, thereby improving the heat transfer efficiency. In addition, the heat exchange flow path part 126 may be disposed close to the inlet port H1 in the first direction. Therefore, when the downstream end 126D of the heat exchange flow path part 126 is opened toward the upstream portion 1122A, the cold air in the heat exchange flow path part 126 may be discharged toward the upstream portion 1122A disposed close to the heat exchange flow path part 126. Therefore, as the upstream portion 1122A comes into contact with the cold air, the condensate water may be effectively produced in the upstream portion 1122A and discharged to the outside. Therefore, the drying performance may be improved.

According to the embodiment of the present disclosure, the heat exchange portion 1122B may extend from the downstream end 1122A3D of the upstream portion 1122A. In this case, gradients of the two opposite surfaces in the first direction at the downstream end 1122A3D of the upstream portion 1122A may correspond to gradients of the two opposite surfaces in the first direction at the upstream end 1122BU of the heat exchange portion 1122B. Therefore, the flow direction of the air at the downstream end 1122A3D of the upstream portion 1122A corresponds to the extension direction at the upstream end 1122BU of the heat exchange portion 1122B before the air in the upstream portion 1122A is introduced into the heat exchange portion 1122B. Therefore, the air may flow in the extension direction of the heat exchange portion 1122B in the heat exchange portion 1122B and be comparatively uniformly dispersed in the width direction, and the turbulent flow may not occur. Therefore, the heat exchange may be uniformly performed in a wide area, which makes it possible to improve the heat transfer efficiency and reduce the flow resistance. Therefore, the drying efficiency and energy efficiency may be improved.

According to the embodiment of the present disclosure, the upstream portion 1122A may have one or more guides G1, G2, and G3 protruding in the second direction and extending in a longitudinal direction of the upstream portion 1122A. Therefore, the flow direction of the air may be stably changed along the one or more guides G1, G2, and G3 in the upstream portion 1122A, which makes it possible to reduce the flow resistance and improve the drying efficiency and energy efficiency.

In addition, the air flowing in the upstream portion 1122A may be appropriately distributed in the width direction by the one or more guides G1, G2, and G3 without being concentrated on any one side in the width direction of the upstream portion 1122A. Therefore, the flow resistance in the upstream portion 1122A may be reduced, and the drying efficiency and energy efficiency may be improved. In addition, since the air in the upstream portion 1122A may be distributed in the width direction and introduced into the heat exchange portion 1122B, the air may uniformly flow in the width direction in the heat exchange portion 1122B, and the turbulent flow may not occur. Therefore, the heat exchange may be uniformly performed in a wide area, which makes it possible to improve the heat transfer efficiency and reduce the flow resistance. Therefore, the drying efficiency and energy efficiency may be improved.

According to the embodiment of the present disclosure, the guide may be a vane. Therefore, the parts of the air appropriately distributed in the width direction by the one or more guides G1, G2, and G3 may not be mixed in the upstream portion 1122A. Therefore, the flow direction of the air may be more stably changed along the one or more guides G1, G2, and G3, and the flow resistance may be reduced, which makes it possible to further improve the drying efficiency and energy efficiency. In addition, since the air in the upstream portion 1122A may be introduced into the heat exchange portion 1122B in the state in which the air is appropriately distributed in the width direction, the air may uniformly flow in the width direction in the heat exchange portion 1122B, and the turbulent flow may not occur. Therefore, the heat exchange may be uniformly performed in a wide area, which makes it possible to improve the heat transfer efficiency and reduce the flow resistance. Therefore, the drying efficiency and energy efficiency may be improved.

According to the embodiment of the present disclosure, the plurality of guides G1, G2, and G3 may be disposed to be spaced apart from one another at predetermined intervals on the upstream portion 1122A. As the guide is positioned at the upper side, the first direction distance HD1, HD2 or HD3 from the heat exchange flow path part 126 to an upstream end GE1, GE2 or GE3 of the guide G1, G2 or G3 may increase. Therefore, the guide (e.g., G3) positioned at the upper side may further extend and protrude toward the inlet port H1 in the first direction than the guide (e.g., G1) positioned at the lower side. Therefore, even though the air in the upstream portion 1122A receives a higher pressure (e.g., negative pressure) from the inner flow path (e.g., CH1) than from the outer flow path (e.g., CH4), the air is caught by the guide (e.g., G3) positioned at the upper side and introduced into the outer flow path (e.g., CH4) first before being introduced into the inner flow path (e.g., CH1). Therefore, the air may be uniformly distributed in the width direction in the upstream portion 1122A, which makes it possible to improve the drying efficiency and energy efficiency.

According to the embodiment of the present disclosure, a slit SL may be formed in the guide. Therefore, the condensate water produced in the upstream portion 1122A flows along the one or more guides G1, G2, and G3 first. When the condensate water meets the slit SL, the condensate water penetrates the one or more guides G1, G2, and G3 through the slits SL and flows downward, and finally, the condensate water may be discharged to the outside of the upstream portion 1122A. Therefore, the condensate water produced in the upstream portion 1122A is not introduced into the condensing duct 112, which makes it possible to improve the drying performance.

According to the embodiment of the present disclosure, the slit SL may be inclined downwardly in a direction becoming closer to the center H1C of the inlet port H1. Therefore, the position of the slit SL on the upper surface of the guide G1, G2, or G3 may be more distant from the inlet port H1 than the position of the slit SL on the lower surface of the guide G1, G2, or G3 by a difference value between the positions (the positions on the upper surface and the lower surface). Therefore, the condensate water, which is produced at the point distant from the inlet port H1 by the difference value between the positions, may also be discharged through the slits SL, which makes it possible to improve the drying performance. In addition, the position of the slit SL on the lower surface of the guide G1, G2, or G3 may be closer to the inlet port H1 than the position of the slit SL on the upper surface of the guides G1, G2, or G3 by the difference value between the positions (the positions on the upper surface and the lower surface). Therefore, the condensate water passing through the slit SL may quickly and easily reach the inlet port H1 and be discharged to the outside of the upstream portion 1122A through the inlet port H1, which makes it possible to improve the drying performance.

In addition, when the condensate water passes through the slit SL, the condensate water gets closer to the inlet port H1 by the difference value between the positions of the slit SL on the upper surface and the lower surface of the guide G1, G2, or G3 in accordance with the inclination of the slit SL. Therefore, when the slits SL1, SL2, and SL3 are respectively formed in the plurality of guides G1, G2, and G3 disposed to be spaced apart from one another at predetermined intervals in the vertical direction, the slits SL1, SL2, and SL3 may be formed such that as the guides G1, G2, and G3 are positioned at the upper side, first direction distances HD4, HD5, and HD6 from the center H1C of the inlet port H1 to the slits SL increase. Therefore, as the guides G1, G2, and G3 are positioned at the upper side, even the condensate water produced at the point distant from the inlet port H1 may be discharged through the slits SL1, SL2, and SL3 formed in the guides G1, G2, and G3, which makes it possible to improve the drying performance.

According to the embodiment of the present disclosure, the slits SL1, SL2, and SL3 may be respectively formed in the plurality of guides G1, G2, and G3 disposed to be spaced apart from one another at predetermined intervals, and the first direction distance HD4, HD5 or HD6 from the center H1C of the inlet port H1 to the slit SL1, SL2 or SL3 may increase or decrease as the guide is positioned at the upper side. Therefore, the condensate water, which flows downward through the slit (e.g., SL3) formed in the guide (e.g., G3) positioned at the upper side, may continuously flow downward through the slit (e.g., SL2) formed in the guide (e.g., G2) positioned at the lower side. Therefore, even though the plurality of guides G1, G2, and G3 is disposed vertically in the upstream portion 1122A, the condensate water produced in the upstream portion 1122A may flow downward while penetrating the plurality of guides G1, G2, and G3, and thus the condensate water may finally be discharged to the outside of the upstream portion 1122A. Therefore, the condensate water produced in the upstream portion 1122A is not introduced into the condensing duct 112, which makes it possible to improve the drying performance. In addition, when the first direction distances HD4, HD5, and HD6 increase as the guides G1, G2, and G3 are positioned at the upper side, even the condensate water produced at the point distant from the inlet port H1 may be discharged through the slits SL1, SL2, and SL3 formed in the guides G1, G2, and G3 as the guides G1, G2, and G3 are positioned at the upper side, which makes it possible to improve the drying performance.

According to the embodiment of the present disclosure, the slit SL1, SL2, or SL3 formed in the guide G1, G2, or G3, which is positioned at the lowest portion among the guides G1, G2, and G3, may be positioned in a vertically upward direction or in an upward direction inclined toward the other side in the first direction from the upper end UP of the bent inner surface of the upstream portion 1122A. Therefore, since the condensate water produced in the upstream portion 1122A continuously passes through the slits SL1, SL2, and SL3 and then finally flows to the lower end (upstream end) of the ascending duct portion 1122A2, the condensate water may be discharged to the outside of the upstream portion 1122A. Therefore, the condensate water produced in the upstream portion 1122A is not introduced into the condensing duct 112, which makes it possible to improve the drying performance.

The specific effects of the present disclosure, together with the above-mentioned effects, will be described along with the description of specific items for carrying out the present disclosure.

DETAILED DESCRIPTION OF EXEMPLARY IMPLEMENTATIONS

Figure 1:
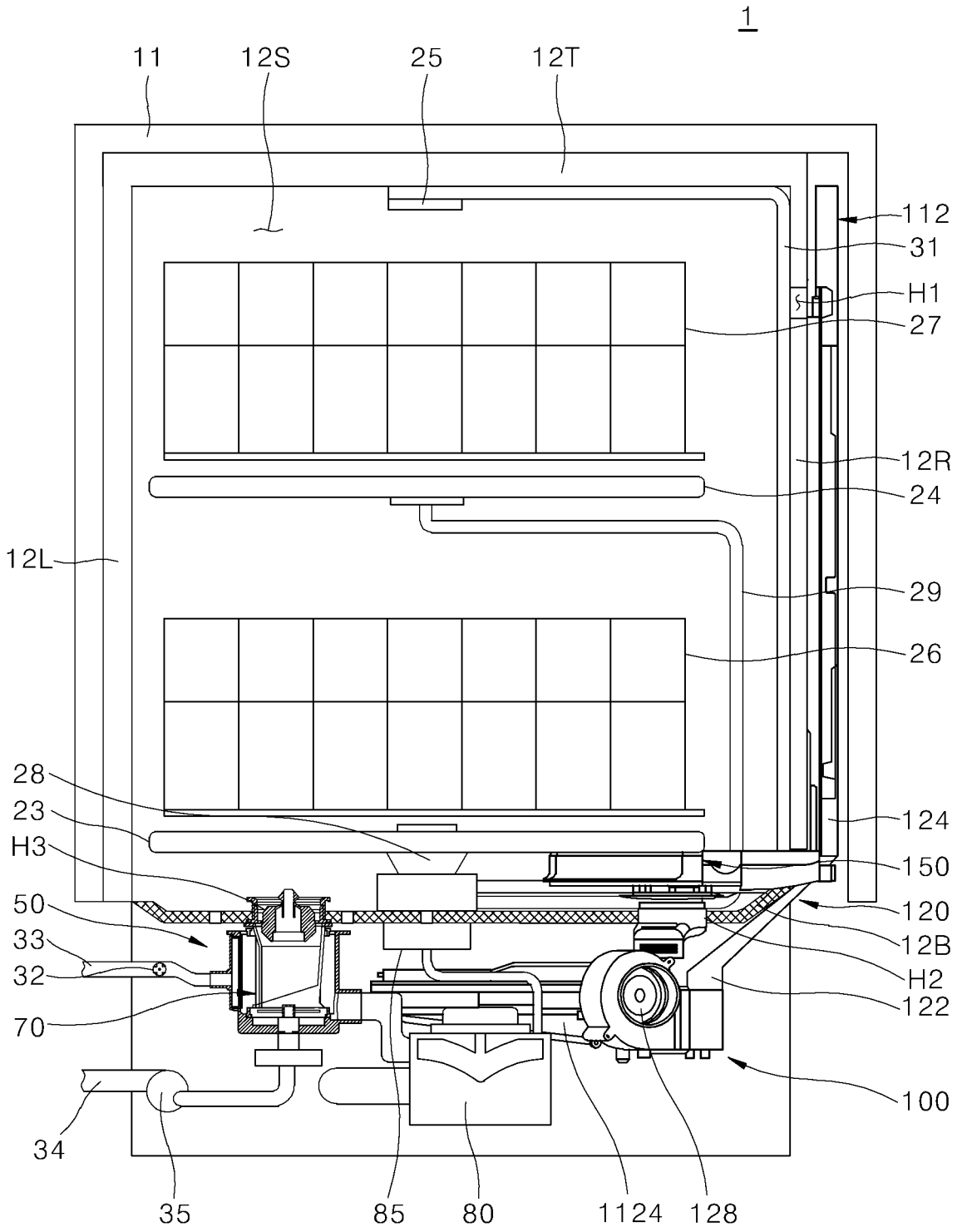
FIG. 1 is a cross-sectional view of a dishwasher according to an embodiment of the present disclosure.

The above-mentioned objects, features, and advantages will be described in detail below with reference to the accompanying drawings, and thus the technical spirit of the present disclosure will be easily carried out by those skilled in the art to which the present disclosure pertains. In the description of the present disclosure, the specific descriptions of publicly known technologies related with the present disclosure will be omitted when it is determined that the specific descriptions may unnecessarily obscure the subject matter of the present disclosure. Hereinafter, exemplary embodiments of the present disclosure will be described in detail with reference to the accompanying drawings. In the drawings, the same reference numerals are used to indicate the same or similar constituent elements.

The present disclosure is not limited to the embodiments disclosed herein, but will be variously changed and implemented in various different forms. The embodiments are provided so that the present disclosure will be thorough and complete, and also to provide a more complete understanding of the scope of the present disclosure to those of ordinary skill in the art. Therefore, it should be understood that the present disclosure is not limited to the embodiments disclosed below, but the configuration of any one embodiment and the configuration of another embodiment can be substituted or added, and the present disclosure includes all alterations, equivalents, and alternatives that are included in the technical spirit and scope of the present disclosure.

It should be interpreted that the accompanying drawings are provided only to allow those skilled in the art to easily understand the exemplary embodiments disclosed in the present specification, and the technical spirit disclosed in the present specification is not limited by the accompanying drawings, and includes all alterations, equivalents, and alternatives that are included in the spirit and the technical scope of the present disclosure. In the drawings, sizes or thicknesses of constituent elements may be exaggerated, increased, or decreased for convenience of understanding, but the protection scope of the present disclosure should not be restrictively construed.

The terms used in the present specification are used only for the purpose of describing particular examples or embodiments and are not intended to limit the present disclosure. Further, singular expressions include plural expressions unless clearly described as different meanings in the context. In the present application, the terms "comprises," "comprising," "includes," "including," "containing," "has," "having", and other variations thereof are inclusive and therefore specify the presence of features, integers, steps, operations, elements, components, and/or combinations thereof disclosed in the specification. That is, in the present application, the terms "comprises," "comprising," "includes," "including," "containing," "has," "having", and other variations thereof do not preclude the presence or addition of one or more other features, integers, steps, operations, elements, components, and/or combinations thereof. It should not be interpreted that in the present application, the terms "comprises," "comprising," "includes," "including," "containing," "has," "having", and other variations thereof necessarily include features, integers, steps, operations, elements, components, and/or combinations thereof disclosed in the specification.

The terms including ordinal numbers such as 'first', 'second', and the like may be used to describe various constituent elements, but the constituent elements are not limited by the terms. These terms are used only to distinguish one constituent element from another constituent element. Unless explicitly described to the contrary, the first constituent element may, of course, be the second constituent element.

When one constituent element is described as being "coupled" or "connected" to another constituent element, it should be understood that one constituent element can be coupled or connected directly to another constituent element, and an intervening constituent element can also be present between the constituent elements. When one constituent element is described as being "coupled directly to" or "connected directly to" another constituent element, it should be understood that no intervening constituent element is present between the constituent elements.

When one constituent element is described as being "disposed/positioned higher than" or "disposed/positioned lower than" another constituent element, it should be understood that one constituent element can be disposed/positioned directly on or beneath another constituent element, and a space or an intervening constituent element can also be present between the constituent elements.

Unless otherwise defined, all terms used herein, including technical or scientific terms, have the same meaning as commonly understood by those skilled in the art to which the present disclosure pertains. The terms such as those defined in a commonly used dictionary should be interpreted as having meanings consistent with meanings in the context of related technologies and should not be interpreted as ideal or excessively formal meanings unless explicitly defined in the present application.

For the convenience of description, a lateral direction of a first condensing duct 1122 to be described below is defined as a first direction, and a direction which intersects the first condensing duct 1122 (e.g., a direction which intersects an extension direction of the first condensing duct) is defined as a second direction. The first direction and the vertical direction may correspond to a direction in which an outer surface of a tub 12 facing the first condensing duct 1122 and the first condensing duct 1122 extend. The second direction may correspond to a direction in which the first condensing duct 1122 and the outer surface of the tub 12 face each other. A vertical direction, the first direction, and the second direction may intersect.

The first direction and the second direction may vary depending on the disposition of the first condensing duct 1122.

Figure 3:
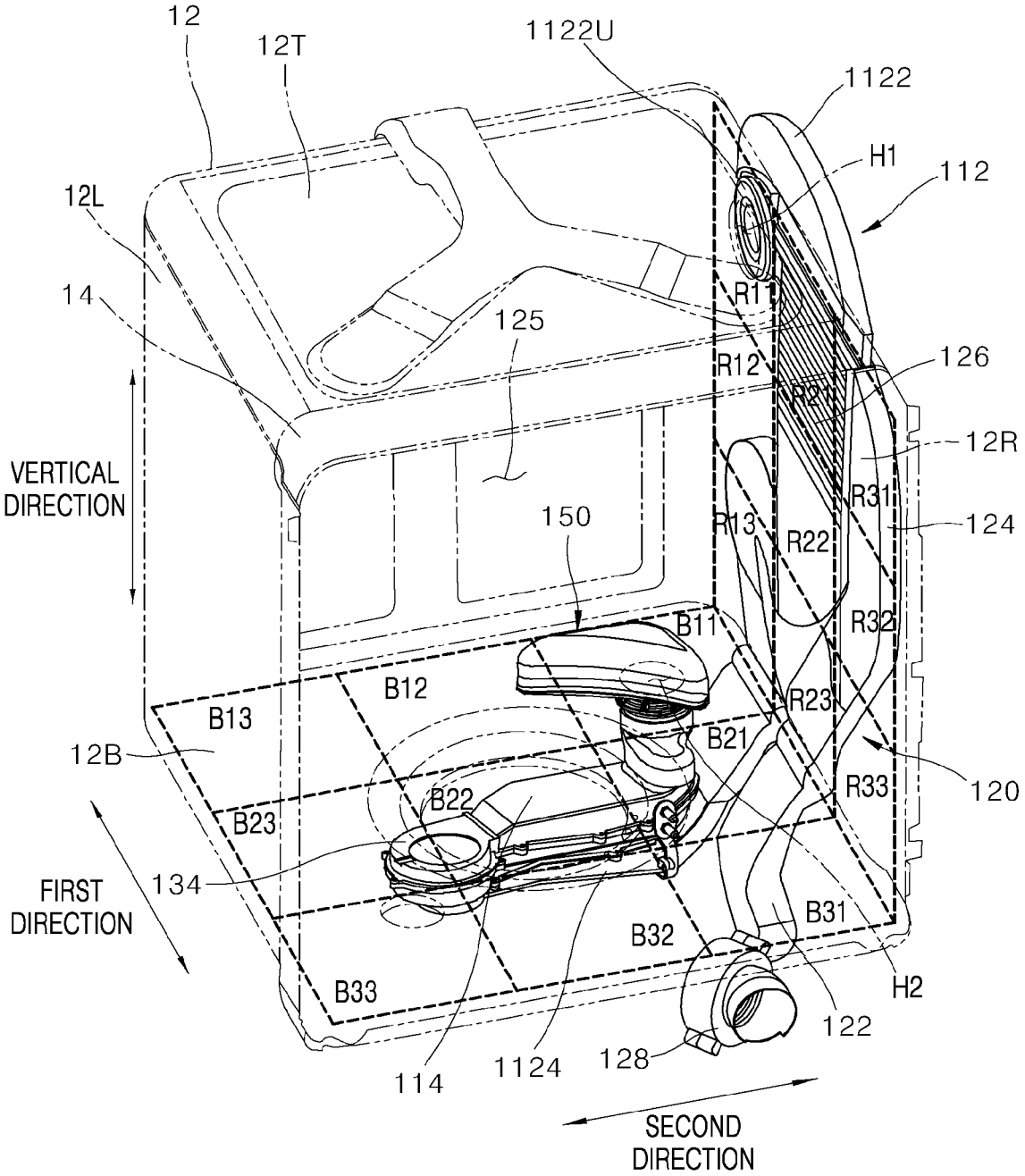
FIGS. 3 to 6 are a perspective view, a front view, a side view, and a top plan view illustrating the drying device and the tub according to the embodiment of the present disclosure.
Figure 4:
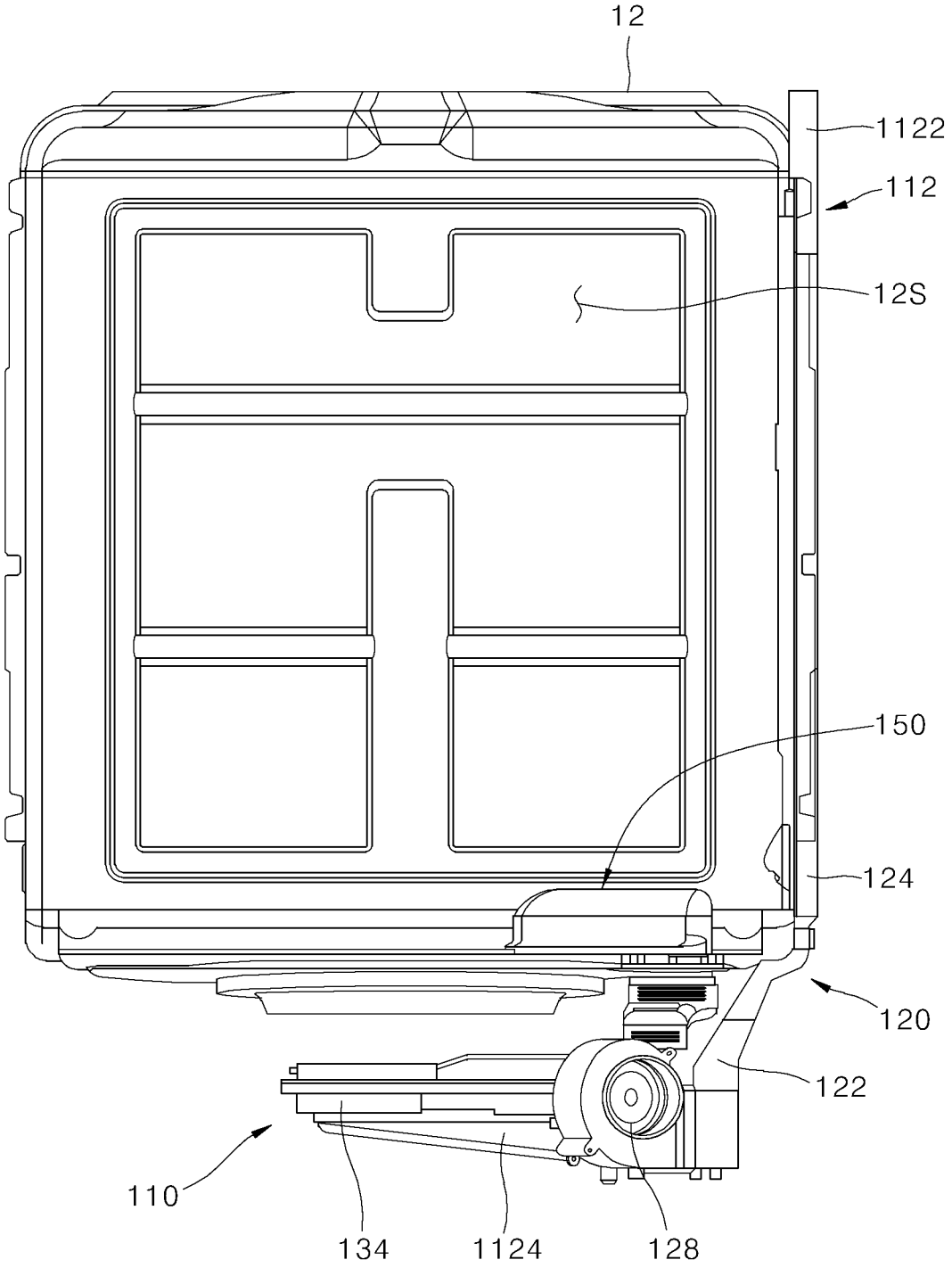

For example, when the first condensing duct 1122 is disposed to face an outer surface of one sidewall 12R of a tub 12 as illustrated in FIG. 3, the first direction may correspond to a forward/rearward direction. In this case, the forward/rearward direction is a direction toward a front surface or a rear surface of a door 14 of a dishwasher 1 in a state in which the door 14 is closed. In this case, the second direction may correspond to a leftward/rightward direction. In this case, the leftward/rightward direction is a direction toward the left and right sides in the drawings (FIGS. 1 and 4) illustrating the front surface of the door in the closed state.

As another example, unlike the drawings, when the first condensing duct 1122 is disposed to face an outer surface of a rear wall 12RR of the tub 12, the first direction may correspond to the leftward/rightward direction. In this case, the second direction may correspond to the forward/rearward direction. In this case, the leftward/rightward direction and the forward/rearward direction are as described above.

Hereinafter, a case in which the first condensing duct 1122 is disposed to face the outer surface of the one sidewall 12R of the tub 12 will be described. Therefore, the first direction may correspond to the forward/rearward direction, and the second direction may correspond to the leftward/rightward direction. However, the present disclosure is not limited thereto, and the first direction and the second direction may vary depending on a position of the first condensing duct 1122 as described above.

Meanwhile, a condensing duct defined in the claims means the first condensing duct 1122 of a condensing duct 112 to be described below.

Hereinafter, a dishwasher according to several embodiments of the present disclosure will be described.

FIG. 1 is a cross-sectional view of a dishwasher according to an embodiment of the present disclosure.

Referring to FIG. 1, the dishwasher 1 according to the embodiment may include a cabinet 11, the tub 12, a plurality of spray arms 23, 24, and 25, a sump 50, a filter 70, a washing pump 80, a switching valve 85, a water supply valve 32, a water drain pump 35, and a drying device 100. The respective components will be described.

The cabinet 11 may define an external appearance of the dishwasher 1.

The tub 12 may be disposed in the cabinet 11. The tub 12 may have a hexahedral shape opened at a front side thereof. However, the shape of the tub 12 is not limited thereto, and the tub 12 may have various shapes.

A washing space 12S may be formed in the tub 12 and accommodate a washing target. A door 14 (FIG. 2) for opening or closing the washing space 12S may be provided at a front side of the tub 12.

An inlet port H1 and an outlet port H2, which communicate with the drying device 100, may be formed in the sidewall 12R and a bottom 12B of the tub 12. In this regard, this configuration will be described. In addition, the bottom 12B of the tub 12 has a communication hole H3 through which a washing liquid is introduced into the sump 50.

The door 14 (FIG. 2) may be disposed at the front side of the tub 12 and open or close the washing space 12S.

A plurality of racks 26 and 27 for accommodating the washing targets such as dishes may be disposed in the washing space 12S. The plurality of racks 26 and 27 may include a lower rack 26 disposed at a lower side of the washing space 12S, and an upper rack 27 disposed at an upper side of the washing space 12S. The lower rack 26 and the upper rack 27 may be disposed to be spaced apart from each other vertically and withdrawn toward a location in front of the tub 12 by sliding.

The plurality of spray arms 23, 24, and 25 may be disposed to be spaced apart from one another vertically. The plurality of spray arms 23, 24, and 25 may include a low spray arm 23, an upper spray arm 24, and a top spray arm 25. The low spray arm 23 may spray the washing liquid upward toward the lower rack 26. The upper spray arm 24 may be disposed above the low spray arm 23 and spray the washing liquid upward toward the upper rack 27. The top spray arm 25 may be disposed at an uppermost end of the washing space 12S and spray the washing liquid downward.

The plurality of spray arms 23, 24, and 25 may be supplied with the washing liquid from the washing pump 80 through the plurality of spray arm connecting flow tubes 28, 29, and 31.

The sump 50 may be provided lower than the bottom 12B of the tub 12 and collect and store the washing liquid. Specifically, the sump 50 may be connected to a water supply flow path 33 and supplied with the clean washing liquid including no foreign substances through the water supply flow path 33, and the sump 50 may store the clean washing liquid. In addition, the sump 50 may be supplied with and store the washing liquid from which foreign substances are removed by the filter 70.

The filter 70 may be disposed in the sump 50 and installed in the communication hole H3. The filter 70 may filter out foreign substances from the washing liquid containing foreign substances and moving from the tub 12 to the sump 50.

The water supply valve 32 may control the washing liquid supplied from a water source through the water supply flow path 33. When the water supply valve 32 is opened, the washing liquid supplied from the external water source may be introduced into the sump 50 through the water supply flow path 33.

A water drain flow path 34 may be connected to the water drain pump 35 and the sump 50.

The water drain pump 35 may be connected to the water drain flow path 34 and include a water drain motor (not illustrated).

When the water drain pump 35 operates, the foreign substances filtered out by the filter 50 or the washing liquid may be discharged to the outside through the water drain flow path 34.

The washing pump 80 may be disposed below the bottom 12B of the tub 12 and supply the plurality of spray arms 23, 24, and 25 with the washing liquid stored in the sump 50.

The switching valve 85 may selectively connect at least one of the plurality of spray arms 23, 24, and 25 to the washing pump 80.

The drying device 100 may be disposed beside one sidewall 12R and lower than the bottom 12B of the tub 12. The drying device 100 may communicate with the inside of the washing space 12S through the inlet port H1 and the outlet port H2. The drying device 100 may dry the washing space 12S in the tub 12.

In a drying step of the dishwasher 1, the moist air in the washing space 12S may be introduced into the drying device 100 through the inlet port H1, and the air dried by the drying device 100 may be introduced into the washing space 12S through the outlet port H2. The circulation of the air may be repeatedly performed. The drying device 100 may improve drying performance through the closed circulation of the air.

Meanwhile, a space capable of installing the drying device 100 may be narrow because various components, such as the washing pump 80, which constitute the dishwasher 1, are installed below the bottom 12B of the tub 12 and the sump 50 is provided lower than the bottom 12B of the tub 12. Therefore, the drying device 100 needs to have a compact structure having a small size so that the drying device 100 may be installed in the dishwasher 1.

A distributor 150 of the drying device 100 may be inserted into the washing space 12S through the outlet port H2. The distributor 150 may be disposed at an edge corner of the tub 12 so as not to collide with the rotating spray arm 23.

Figure 2:
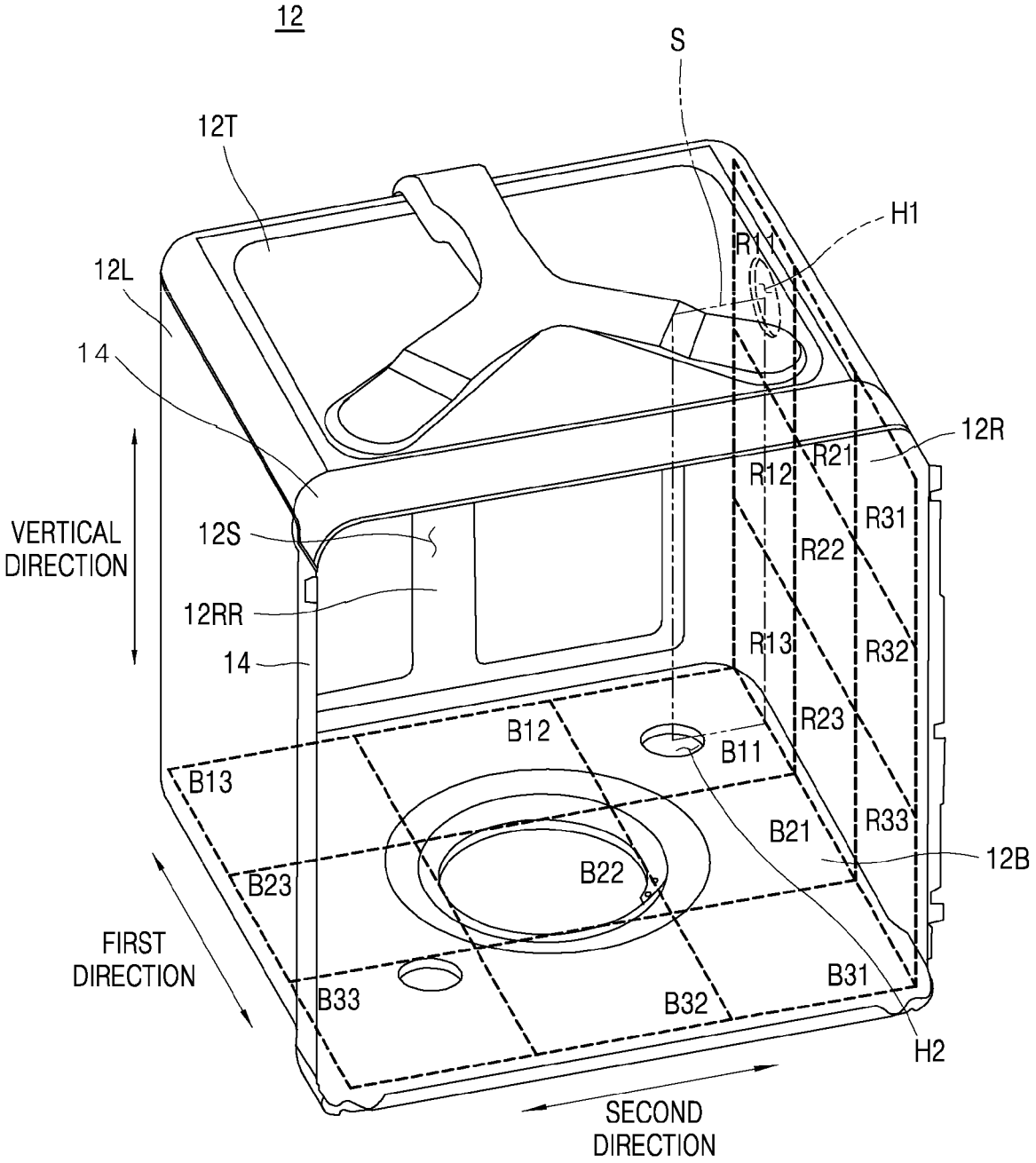
FIG. 2 is a perspective view of a tub according to the embodiment of the present disclosure.
Figure 5:
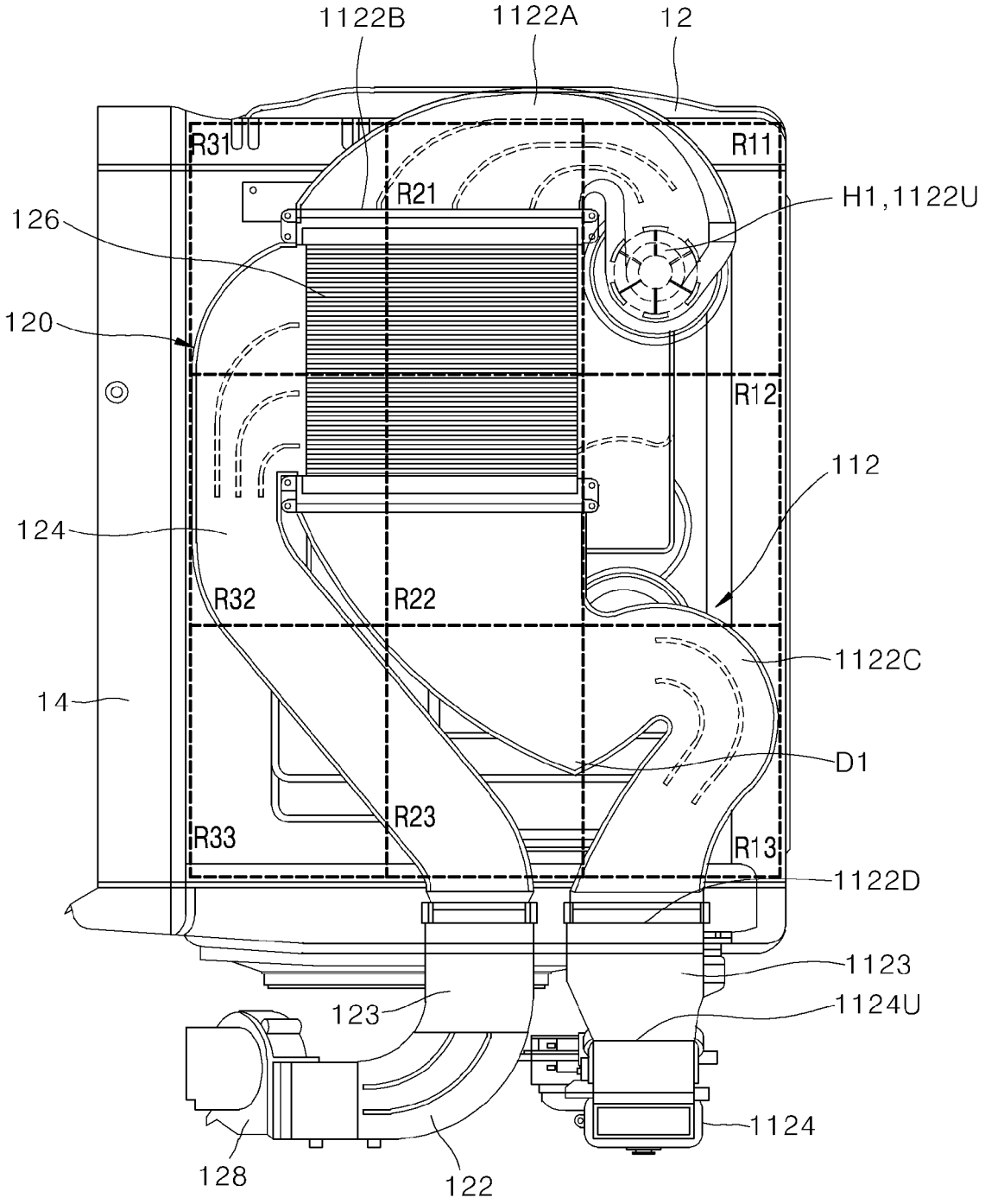
Figure 6:
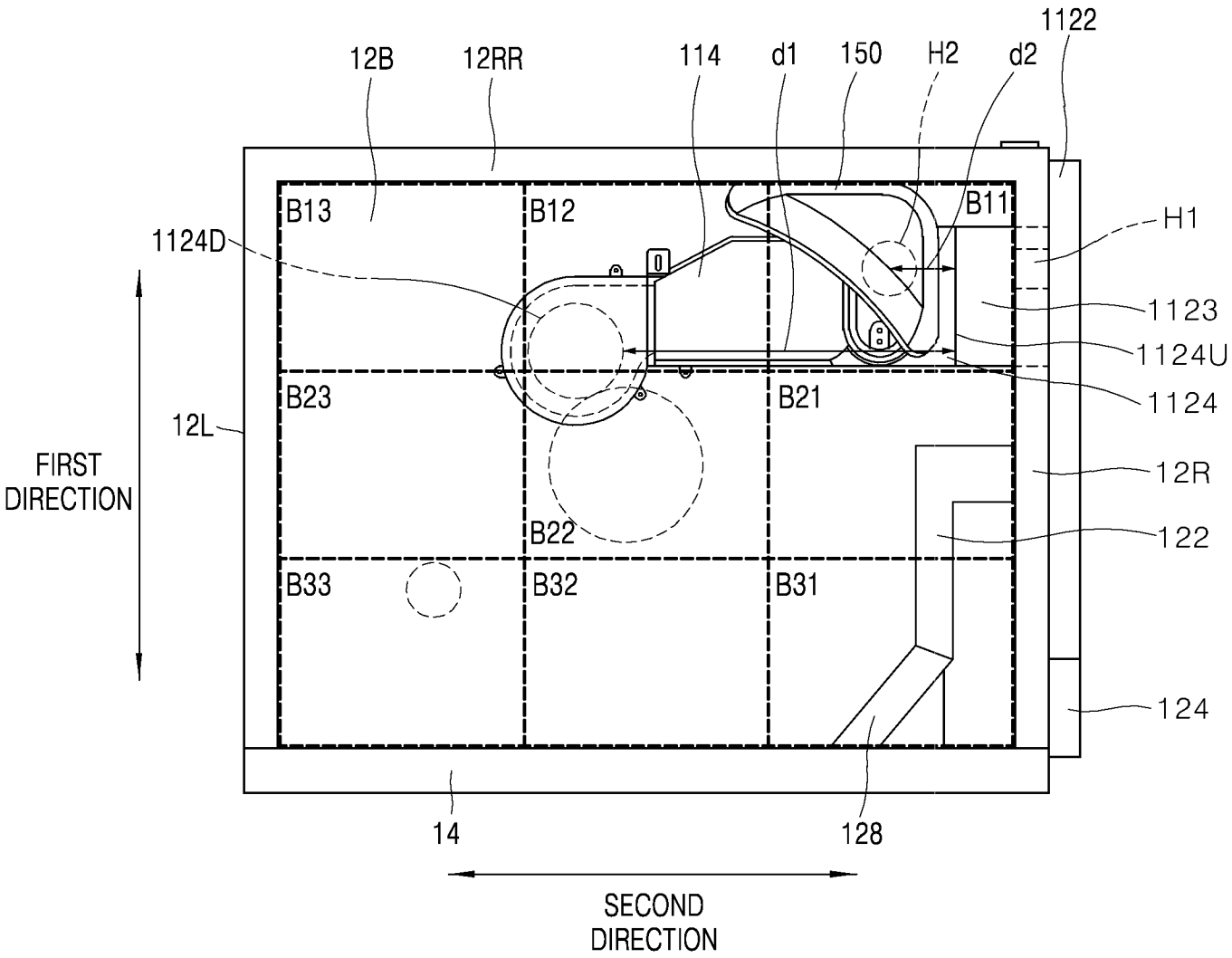
Figure 7:
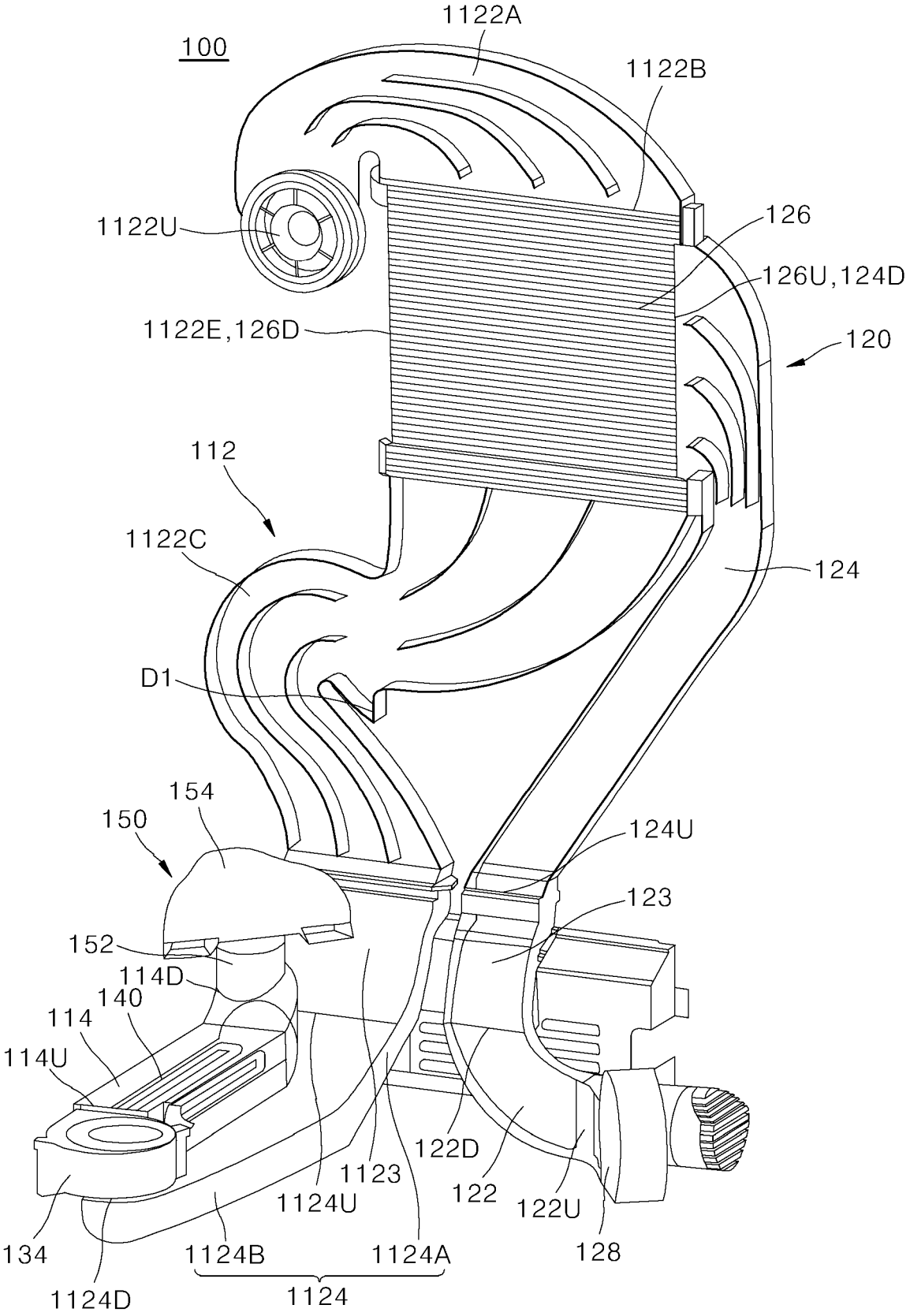
FIG. 7 is a perspective view of a drying device according to the embodiment of the present disclosure.

FIG. 2 is a perspective view of the tub according to the embodiment of the present disclosure, FIGS. 3 to 6 are a perspective view, a front view, a side view, and a top plan view illustrating the drying device and the tub according to the embodiment of the present disclosure, and FIG. 7 is a perspective view of the drying device according to the embodiment of the present disclosure.

Referring to FIG. 2, the tub 12 according to the embodiment may include the bottom 12B, an upper wall 12T, one sidewall 12R, the other sidewall 12L, and the rear wall 12RR. The washing space 12S may be defined in the tub 12 by the bottom 12B, the upper wall 12T, one sidewall 12R, the other sidewall 12L, and the rear wall 12RR. For example, one sidewall 12R may be a right sidewall of the tub 12, and the other sidewall 12L may be a left sidewall of the tub 12.

The door 14 for opening or closing the washing space 12S may be disposed at the front side of the tub 12.

The bottom 12B and the upper wall 12T may face each other in the vertical direction, the rear wall 12RR and the door 14 may face each other in the forward/rearward direction, and one sidewall 12R and the other sidewall 12L may face each other in the leftward/rightward direction. In addition, as illustrated in FIG. 3, since the first condensing duct 1122 is disposed to face the outer surface of one sidewall 12R of the tub 12, the first direction may correspond to the forward/rearward direction, and the second direction may correspond to the leftward/rightward direction, as described above.

The inlet port H1 and the outlet port H2 may be formed in the tub 12. The outlet port H2 may be positioned lower than the inlet port H1. In this case, the lower portion may mean a height lower than a height of the inlet port H1.

Therefore, since high-temperature dry air, which is introduced into the washing space 12S through the outlet port H2, is discharged to the outside of the washing space 12S (to the inside of the drying duct) through the inlet port H1 positioned higher than the outlet port H2, the dry air (e.g., the high-temperature dry air) may be discharged after effectively circulating in the washing space 12S. Therefore, the drying efficiency may be improved.

An example of the positions of the outlet port H2 and the inlet port H1 will be specifically described below.

One sidewall 12R of the tub 12 may be divided into rear portions R11, R12, and R13, central portions R21, R22, and R23, and front portions R31, R32, and R33 in the first direction or the forward/rearward direction. A point at which the rear portion and the central portion of one sidewall 12R are separated may be a point of about ¼ to ⅓ of a width of one sidewall 12R from a rear end to a front side of one sidewall 12R. A point at which the front portion and the central portion of one sidewall 12R are separated may be a point of about ¼ to ⅓ of the width of one sidewall 12R from a front end to a rear side of one sidewall 12R.

In addition, one sidewall 12R of tub 12 may be divided into upper portions R11, R21, and R31, central portions R12, R22, and R32, and lower portions R13, R23, and R33 in the vertical direction or an upward/downward direction. A point at which the upper portion and the central portion of one sidewall 12R are separated may be a point of about ¼ to ⅓ of a height of one sidewall 12R from an upper end to a lower side of one sidewall 12R. A point at which the lower portion and the central portion of one sidewall 12R are separated may be a point of about ¼ to ⅓ of the height of one sidewall 12R from a lower end to an upper side of one sidewall 12R.

Therefore, one sidewall 12R of the tub 12 may be divided into nine regions including a rear upper portion R11, a rear central portion R12, a rear lower portion R13, a central upper portion R21, a central portion R22, a central lower portion R23, a front upper portion R31, a front central portion R32, and a front lower portion R33 in the first direction and the vertical direction.

Like one sidewall 12R, the bottom 12B of the tub 12 may also be divided into nine regions including one rear side portion B11, a rear central portion B12, the other rear side portion B13, one central side portion B21, a central portion B22, the other central side portion B23, one front side portion B31, a front central portion B32, and the other front side portion B33 in the first direction and the second direction.

The inlet port H1 through which the air in the washing space 12S is introduced into the drying duct 110 may be formed in the rear upper portion R11 of one sidewall 12R of the tub 12. In addition, the outlet port H2 through which the air in the drying duct 110 is discharged to the washing space 12S may be formed in one rear side portion B11 of the bottom 12B of the tub 12.

Therefore, since both the outlet port H2 and the inlet port H1 are formed in one rear side of the tub 12, a horizontal distance between the outlet port H2 and the inlet port H1 may decrease. In addition, since the outlet port H2 is formed in the bottom 12B and the inlet port H1 is formed in the upper portion of one sidewall 12R, a vertical distance between the outlet port H2 and the inlet port H1 may increase.

In general, to introduce the air into the specific space and allow the introduced air to effectively circulate in the space, i) it is necessary to prevent the air introduced into the inlet port from flow directly to the outlet port, and ii) it is necessary to decrease the horizontal distance between the air inlet port and the outlet port and increase the vertical distance between the inlet port and the outlet port.

As described above, since the condition ii) is satisfied, the dry air introduced into the washing space 12S through the outlet port H2 may effectively circulate everywhere in the washing space 12S until the dry air is introduced into the drying device 100 through the inlet port H1, thereby improving the drying efficiency. Meanwhile, the condition i) may be satisfied by the distributor 150.

In addition, since both the outlet port H2 and the inlet port H1 are formed at the rear side of the tub 12, the drying duct 110 may be disposed at the periphery of the rear side of the tub 12, and a cold air supply module 120 may be disposed at the periphery of the front side of the tub 12. The periphery of the rear side of the tub 12 may be blocked approximately by the wall, and the periphery of the front side of the tub 12 (particularly, the front space lower than the tub) is opened forward, such that a temperature of the air at the periphery of the front side of the tub 12 may be lower. Therefore, the cold air supply module 120 may effectively reduce humidity of the air in the drying duct 110 by using the cold air at the periphery of the front side of the tub 12, thereby improving the drying performance.

In addition, since the outlet port H2 is formed at the rear side of the tub 12, the distributor 150 of the drying device 100 may be disposed at the rear side of the tub 12. Therefore, when the door 14 disposed at the front side of the tub 12 is opened, the distributor 150 of the drying device 100 does not obstruct a visual field. Therefore, it is possible to improve the aesthetic appearance and easily manage various types of devices in the tub 12 without being hindered by the distributor 150 of the drying device 100.

However, the present disclosure is not limited thereto. Therefore, the positions at which the outlet port H2 and the inlet port H1 are formed are not limited to the specific regions separated in the first direction, the second direction, and the vertical direction. In addition, the positions at which the outlet port H2 and the inlet port H1 are formed are not limited to one sidewall 12R and the bottom 12B.

The outlet port H2 may meet an imaginary vertical surface S that passes through the inlet port H1 and extends in the second direction and the vertical direction. For example, a center of the outlet port H2 may meet the imaginary vertical surface S that passes through a center of the inlet port H1 and extends in the second direction. The configuration in which the outlet port H2 meets the vertical surface S will be described below.

The outlet port H2, which has a minimum value of the horizontal distance from the inlet port H1 among the outlet ports H2 formed in the bottom 12B and spaced apart from one side end of the bottom 12B toward the other side (the other side in the second direction) by a particular distance, is the outlet port H2 that meets the imaginary vertical surface S.

When the outlet port H2 meets the vertical surface S, the horizontal distance between the outlet port H2 formed in the bottom 12B of the tub 12 and the inlet port H1 formed in one sidewall 12R of the tub 12 may be minimized, so the condition ii) is partially satisfied. Therefore the dry air introduced into the washing space 12S through the outlet port H2 may effectively circulate everywhere in the washing space 12S until the dry air is introduced into the drying device 100 through the inlet port H1. Therefore, the drying efficiency may be further improved.

Further referring to FIGS. 3 to 7, the drying device 100 according to the embodiment may include the drying duct 110, the cold air supply module 120, a fan 130, a heater 140, and the distributor 150. However, at least one of the heater 140 and the distributor 150 may be omitted from the drying device 100. The respective components will be described.

[Drying Duct]

The drying duct 110 communicates with the inlet port H1 and the outlet port H2 and is disposed outside the tub 12. The drying duct 110 may include the condensing duct 112 and a return duct 114.

Therefore, because the condensing duct 112 adjoins low-temperature outside air outside the tub 12, moisture vapor contained in the air flowing along the condensing duct 112 is condensed into water and then removed. Therefore, the drying performance may be improved by the simple structure and at low cost.

The condensing duct 112 may include the first condensing duct 1122 and a second condensing duct 1124.

[First Condensing Duct]

The first condensing duct 1122 is disposed outside the tub 12 and may face the outer surface of the tub 12. Specifically, for example, the first condensing duct 1122 may face or adjoin the outer surface or the outer circumferential surface of one sidewall 12R. The first condensing duct 1122 may extend in a vertical direction and a first direction which intersects the vertical direction. The first condensing duct 1122 and the outer surface of the tub 12 may face each other in the second direction.

However, the present disclosure is not limited to this configuration. For example, as described above, the first condensing duct 1122 may face the outer surface of the rear wall 12RR. In this case, as described above, the first direction may correspond to the leftward/rightward direction, and the second direction may correspond to the forward/rearward direction.

An upstream end 1122U of the first condensing duct 1122 may communicate with the inlet port H1 of the tub 12.

Therefore, the condensing duct 112 adjoins the low-temperature air outside the tub 12, such that the moisture vapor contained in the air flowing along the condensing duct 112 is condensed into water and then removed. Therefore, the drying performance may be improved by the simple structure and at low cost.

Specifically, for example, the first condensing duct 1122 may include an upstream portion 1122A, a heat exchange portion 1122B, and a downstream portion 1122C sequentially disposed along the flow direction of the air (FIGS. 5 and 7). The upstream portion 1122A, the heat exchange portion 1122B, and the downstream portion 1122C may be three duct sections of the first condensing duct 1122.

The upstream portion 1122A may communicate with the inlet port H1, and the air may be introduced into the upstream portion 1122A.

The heat exchange portion 1122B may adjoin the cold air supply module 120.

The downstream portion 1122C may communicate with the second condensing duct 1124 and discharge the air to the second condensing duct 1124.

A first water drain port D1 may be formed in the downstream portion 1122C. Therefore, the water introduced through the inlet port H1 or the water condensed in the heat exchange portion 1122B may be discharged to the outside through the first water drain port D1, thereby improving the drying performance of the drying device 100.

A suction fan (not illustrated) may be provided at the upstream end 1122U or the periphery of the upstream end 1122U of the first condensing duct 1122. The suction fan may be a centrifugal fan. The suction fan may improve the drying performance by allowing the air to smoothly flow. Since the centrifugal fan is provided, a transverse width (i.e. width in the second direction in the drawings) of the first condensing duct 1122 may be minimized, thereby miniaturizing the dishwasher 1.

A downstream end 1122D of the first condensing duct 1122 may be positioned in the vicinity of a lower end of the rear portion of one sidewall 12R of the tub 12. In this regard, this configuration will be described.

[Cold Air Supply Module]

The cold air supply module 120 may be disposed outside the tub 12. The cold air supply module 120 may adjoin the first condensing duct 1122.

Specifically, for example, the cold air supply module 120 may include a first outside air inflow duct 122, a second outside air inflow duct 124, and a heat exchange flow path part 126 (FIGS. 5 and 7).

The first outside air inflow duct 122 may be disposed lower than the bottom 12B of the tub 12, and outside air may be introduced through an upstream end 122U.

The second outside air inflow duct 124 may face or adjoin an outer surface of one sidewall 12R of the tub 12. An upstream end 124U may communicate with a downstream end 122D of the first outside air inflow duct 122.

The heat exchange flow path part 126 may adjoin the first condensing duct 1122. In addition, an upstream end 126U of the heat exchange flow path part 126 may communicate with a downstream end 124D of the second outside air inflow duct 124.

Figure 9:
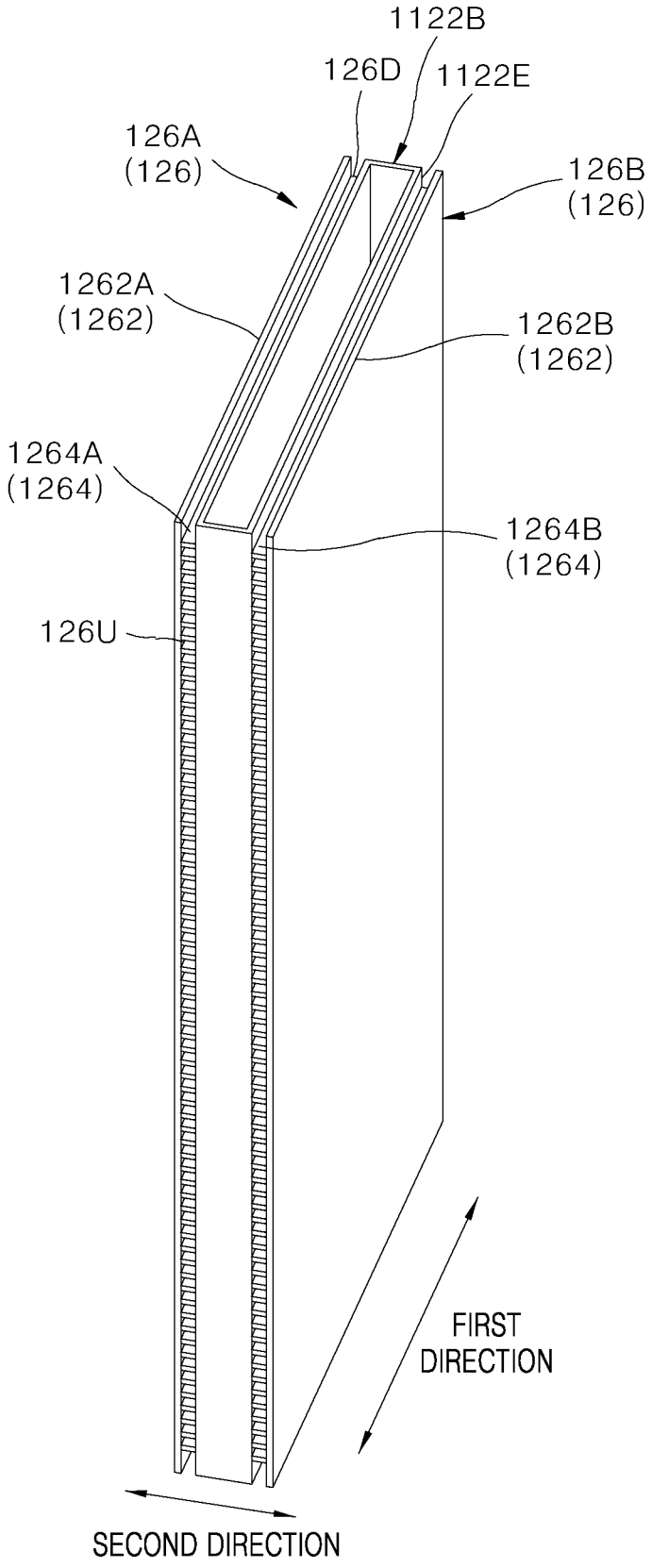
FIG. 9 is a perspective view illustrating a heat exchange portion and a heat exchange flow path part disposed between a first upstream duct and a first downstream duct in the structure illustrated in FIG. 8.

Specifically, for example, the heat exchange flow path part 126 may extend along an outer circumferential surface of the first condensing duct 1122. A downstream end 126D of the heat exchange flow path part 126 may be positioned approximately in parallel in the second direction with an end 1122E in a width direction (the first direction in the drawings) of the first condensing duct 1122 (FIGS. 7 and 9). The air may be discharged to the outside through the downstream end 126D of the heat exchange flow path part 126.

Therefore, the heat exchange flow path part 126 may be configured and the installation space of the heat exchange flow path part 126 may be minimized by the simple configuration and at low cost. In addition, a length of the heat exchange flow path part 126 is decreased, and the flow resistance is reduced, such that the cooling performance may be improved.

The cooling fan 128 may be disposed in the first outside air inflow duct 122 or at the periphery of the upstream end 122U of the first outside air inflow duct 122. The cooling fan 128 may suck the outside air and supply the outside air into the heat exchange flow path part 126.

Therefore, since the cooling fan 128 may be disposed lower than the tub 12, the cooling fan 128 may suck the cold air lower than the tub 12 and supply the cold air to the heat exchange flow path part 126, thereby improving the cooling efficiency. In addition, because the space lower than the tub 12 is comparatively large, it is possible to improve the cooling efficiency by increasing the size of the cooling fan 128.

Meanwhile, a first connection duct 123 may be disposed between the first outside air inflow duct 122 and the second outside air inflow duct 124. The first connection duct 123 may communicate with the downstream end 122D of the first outside air inflow duct 122 and the upstream end 124U of the second outside air inflow duct 124 (FIG. 7).

As described above, the dishwasher may further include the cold air supply module 120 disposed outside the tub 12 and configured to at least partially adjoin the first condensing duct 1122. Therefore, the cold air supply module 120 may effectively remove moisture vapor, which is contained in the air flowing along the first condensing duct 1122, by condensing the moisture vapor into the water. Therefore, the drying performance may be improved by the simple structure and at low cost.

In addition, the cold air supply module 120 includes the first outside air inflow duct 122 disposed lower than the bottom 12B of the tub 12 and configured to allow the outside air to be introduced thereinto, the second outside air inflow duct 124 configured to face or adjoin the outer surface or the outer surface of one sidewall 12R of the tub 12, and the heat exchange flow path part 126 configured to adjoin the first condensing duct 1122 and communicate with the second outside air inflow duct 124. Therefore, it is possible to effectively remove the moisture vapor contained in the air flowing along the first outside air inflow duct 122 by condensing the moisture vapor into water using the cold air lower than the tub 12. Therefore, the drying performance may be improved by the simple structure and at low cost.

The heat exchange flow path part 126 will be described in more detail with reference to FIGS. 8 and 9.

Figure 8:
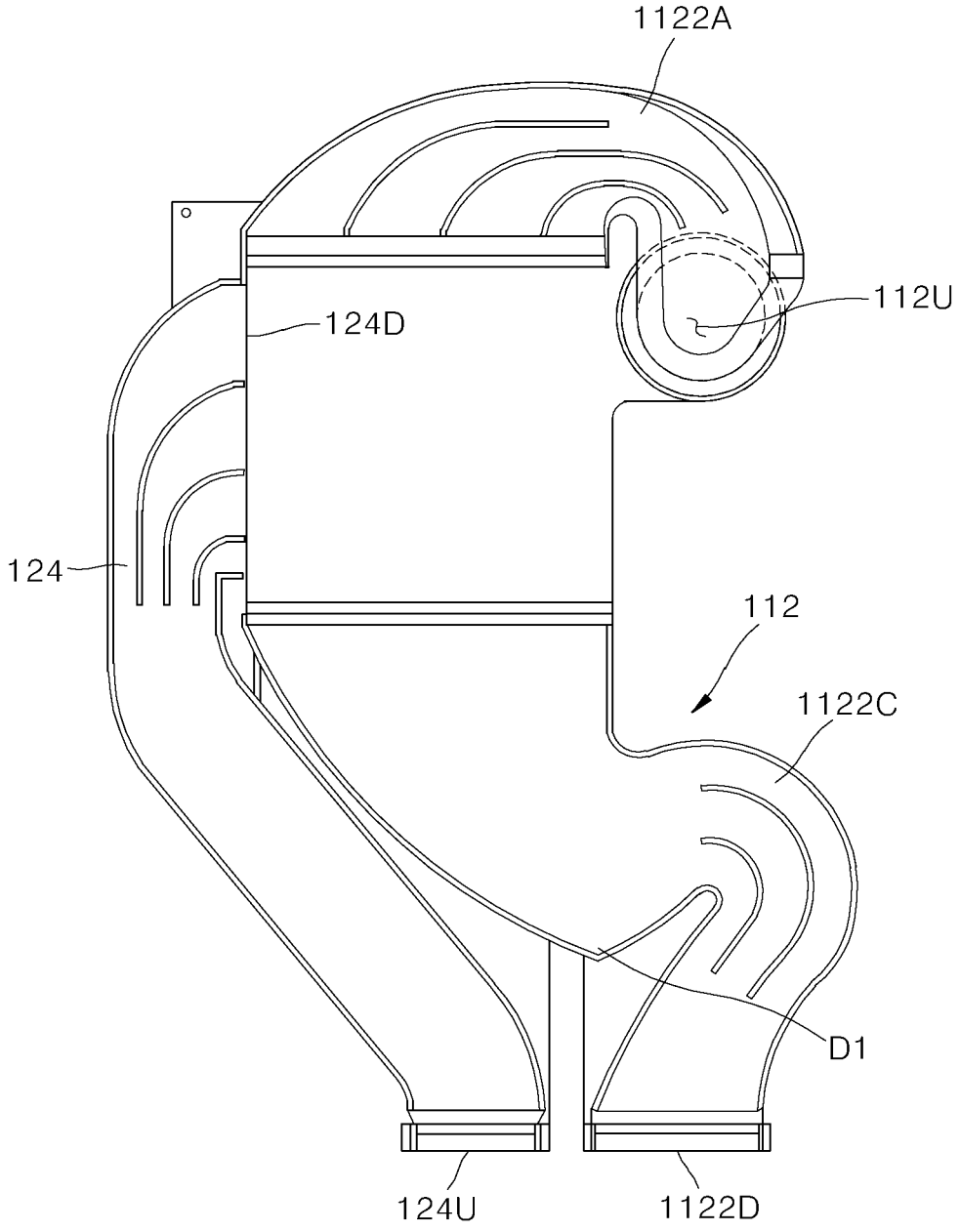
FIG. 8 is a view illustrating a structure in which some components of the drying device illustrated in FIGS. 3 to 7 are integrally manufactured.

FIG. 8 is a view illustrating a structure in which some components of the drying device illustrated in FIGS. 3 to 7 are integrally manufactured, and FIG. 9 is a perspective view illustrating the heat exchange flow path part and the heat exchange portion disposed between the upstream portion and the downstream portion in the structure illustrated in FIG. 8.

Referring to FIG. 8, the upstream portion 1122A, the downstream portion 1122C, and the second outside air inflow duct 124 may be integrated. A vacant space may be formed between the upstream portion 1122A and the downstream portion 1122C. The heat exchange portion 1122B and the heat exchange flow path part 126, which will be described with reference to FIG. 9, may be installed in the vacant space between the upstream portion 1122A and the downstream portion 1122C.

Since the upstream portion 1122A, the downstream portion 1122C, and the second outside air inflow duct 124 are integrated as described above, the manufacturing cost of the drying device 100 may be reduced, and the drying device 100 may be easily installed and maintained.

Referring to FIG. 9, the heat exchange portion 1122B and the heat exchange flow path part 126 may be installed between the upstream portion 1122A and the downstream portion 1122C in the structure illustrated in FIG. 8.

The heat exchange portion 1122B may have a flat tubular shape opened at two opposite ends thereof and communicate vertically with the upstream portion 1122A and the downstream portion 1122C illustrated in FIG. 8.

The heat exchange flow path part 126 may include a plate 1262 and a partition wall 1264.

The plate 1262 may be disposed to face at least one of one surface and the other surface in the second direction of the heat exchange portion 1122B.

The partition wall 1264 may be provided in plural, and the plurality of partition walls 1264 may be disposed in parallel between the plate 1262 and one surface or the other surface in the second direction of the heat exchange portion 1122B.

The plate 1262 and the plurality of partition walls 1264 may extend along the outer circumferential surface of the heat exchange portion 1122B in the width direction (the first direction in the drawings) of the heat exchange portion 1122B that intersects the flow direction of the air flowing in the heat exchange portion 1122B.

When the heat exchange portion 1122B and the heat exchange flow path part 126 illustrated in FIG. 9 are installed in the vacant space between the upstream portion 1122A and the downstream portion 1122C of the structure illustrated in FIG. 8, the downstream end 124D of the second outside air inflow duct 124 may adjoin a lateral end in the first direction of the heat exchange portion 1122B and the plate 1262. Therefore, the cold air introduced into the second outside air inflow duct 124 may flow to the vacant space between the plate 1262 and the heat exchange portion 1122B. In this case, a plurality of flow paths may be formed between the plate 1262 and the heat exchange portion 1122B by the plurality of partition walls 1264 extending in the width direction (the first direction in the drawings) of the heat exchange portion 1122B.

That is, the cold air introduced into the second outside air inflow duct 124 may flow along the plurality of flow paths formed by the heat exchange portion 1122B, the plate 1262, and the plurality of partition walls 1264. The direction in which the cold air flows along the plurality of flow paths formed by the heat exchange flow path part 126 may intersect the direction in which the moist air flows along the heat exchange portion 1122B.

In this case, as described above, the downstream end 126D of the heat exchange flow path part 126 may be positioned approximately in parallel in the second direction with the end 1122E in the width direction (the first direction in the drawings) of the first condensing duct 1122 (FIG. 9).

As described above, the heat exchange flow path part 126 includes the plate 1262 disposed to face at least one of one surface and the other surface in the second direction of the heat exchange portion 1122B, and the plurality of partition walls 1264 disposed in parallel between the plate 1262 and one surface or the other surface in the second direction of the heat exchange portion 1122B. Therefore, heat exchange flow path part 126 may be configured by the simple configuration and at low cost. In addition, since the cold air flows along the outer circumferential surface of the heat exchange portion 1122B, the heat exchange efficiency may be improved. In addition, since the cold air flows along the plurality of flow paths separated from one another, the heat exchange is uniformly performed in a wide area, such that the heat exchange efficiency may be improved.

In addition, as illustrated in FIG. 9, since the heat exchange portion 1122B and the heat exchange flow path part 126 are manufactured separately and then installed between the upstream portion 1122A and the downstream portion 1122C of the structure illustrated in FIG. 8, the drying device 100 may be easily manufactured, replaced, and repaired. Therefore, the manufacturing cost may be reduced, and the maintenance may be easily performed.

The first condensing duct 1122 and the heat exchange flow path part 126 will be described with reference to FIGS. 10 to 12.

[Upstream Portion, Heat Exchange Portion, Heat Exchange Flow Path Part]

Figure 10:
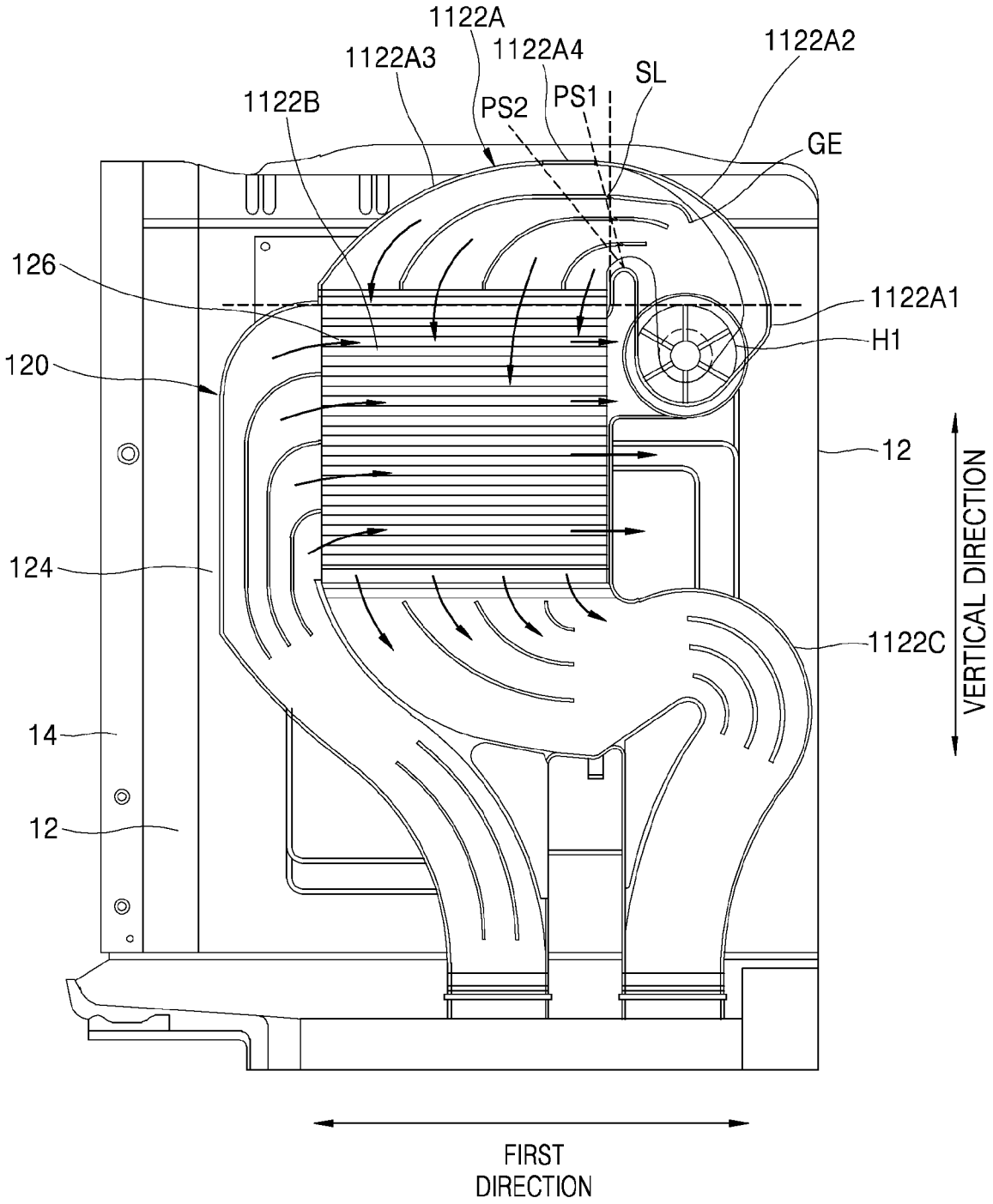
FIG. 10 is a side view illustrating a tub and a part of a drying device according to another embodiment of the present disclosure.

FIG. 10 is a side view illustrating a tub and a part of a drying device according to another embodiment of the present disclosure. FIGS. 11 and 12 are enlarged views of the top side of FIG. 10, and FIG. 13 is a view illustrating a state in which a position of a slit illustrated in FIG. 12 is changed.

Hereinafter, unless otherwise specified, the description with reference to FIGS. 1 to 9 will apply to the following description.

Referring to FIG. 10, as described above, the first condensing duct 1122 may include the upstream portion 1122A and the heat exchange portion 1122B. In addition, the first condensing duct 1122 may include the downstream portion 1122C.

An upstream end 1122A1U of the upstream portion 1122A may communicate with the inlet port H1. For example, the upstream end 1122A1U of the upstream portion 1122A may be coupled directly to the inlet port H1.

The upstream portion 1122A may be bent from the inlet port H1 and extend. For example, the upstream portion 1122A may be bent at about degrees in the first direction and the vertical direction and extend.

The upstream portion 1122A may be bent to ascend from the inlet port H1 and then descend. That is, the upstream portion 1122A may sequentially include an ascending portion (hereinafter, referred to as an 'ascending duct portion') and a descending portion (hereinafter, referred to as a 'descending duct portion'). Therefore, the air may ascend and then descend in the upstream portion 1122A.

The upstream portion 1122A is bent to ascend from the inlet port H1 as described above. Therefore, even though the water in the tub 12 is introduced into the upstream portion 1122A through the inlet port H1, the introduced water cannot pass through the ascending duct portion 1122A2 because of the weight of the water. Therefore, it is possible to prevent the water from being introduced into the condensing duct 112. Therefore, it is possible to improve the drying performance, prevent the drying device 100 from being broken down by the water, and inhibit proliferation of bacteria or mold in the condensing duct 112. In addition, since the upstream portion 1122A is bent to ascend and then descend, the upstream portion 1122A may be connected to the heat exchange portion 1122B which is connected to the upstream portion 1122A and extends downward.

Meanwhile, since the air ascends and then descends in the upstream portion 1122A, the ascending duct portion 1122A2 and a descending duct portion 1122A3 may have a height (length in the vertical direction) which is not small. The flow direction of the air is rapidly changed from upward direction into the first direction when the height of the ascending duct portion 1122A2 is small, and the flow direction of the air is rapidly changed from the first direction into downward direction when the height of the descending duct portion 1122A3 is small, which may cause irregularity of the airflow and create a turbulent flow. For this reason, the flow resistance may be significantly increased, and the drying efficiency and energy efficiency may deteriorate.

A cross-sectional area of a downstream end 1122A3D of the upstream portion 1122A may be larger than a cross-sectional area of the upstream portion 1122A at a height of an upper end H1UE of the inlet port H1 (a cross-sectional area of an upstream end of an inflow portion to be described below). Therefore, even though the flow direction of the air in the upstream portion 1122A is considerably changed, the flow resistance may be reduced, thereby improving the drying efficiency and energy efficiency. In addition, since the cross-sectional area of the downstream end 1122A3D of the upstream portion 1122A is large, a cross-sectional area of the heat exchange flow path part 126 communicating with the downstream end 1122A3D of the upstream portion 1122A may also be large. Therefore, the contact area between the heat exchange flow path part 126 and the heat exchange portion 1122B may increase, thereby improving the heat transfer efficiency.

Figure 11:
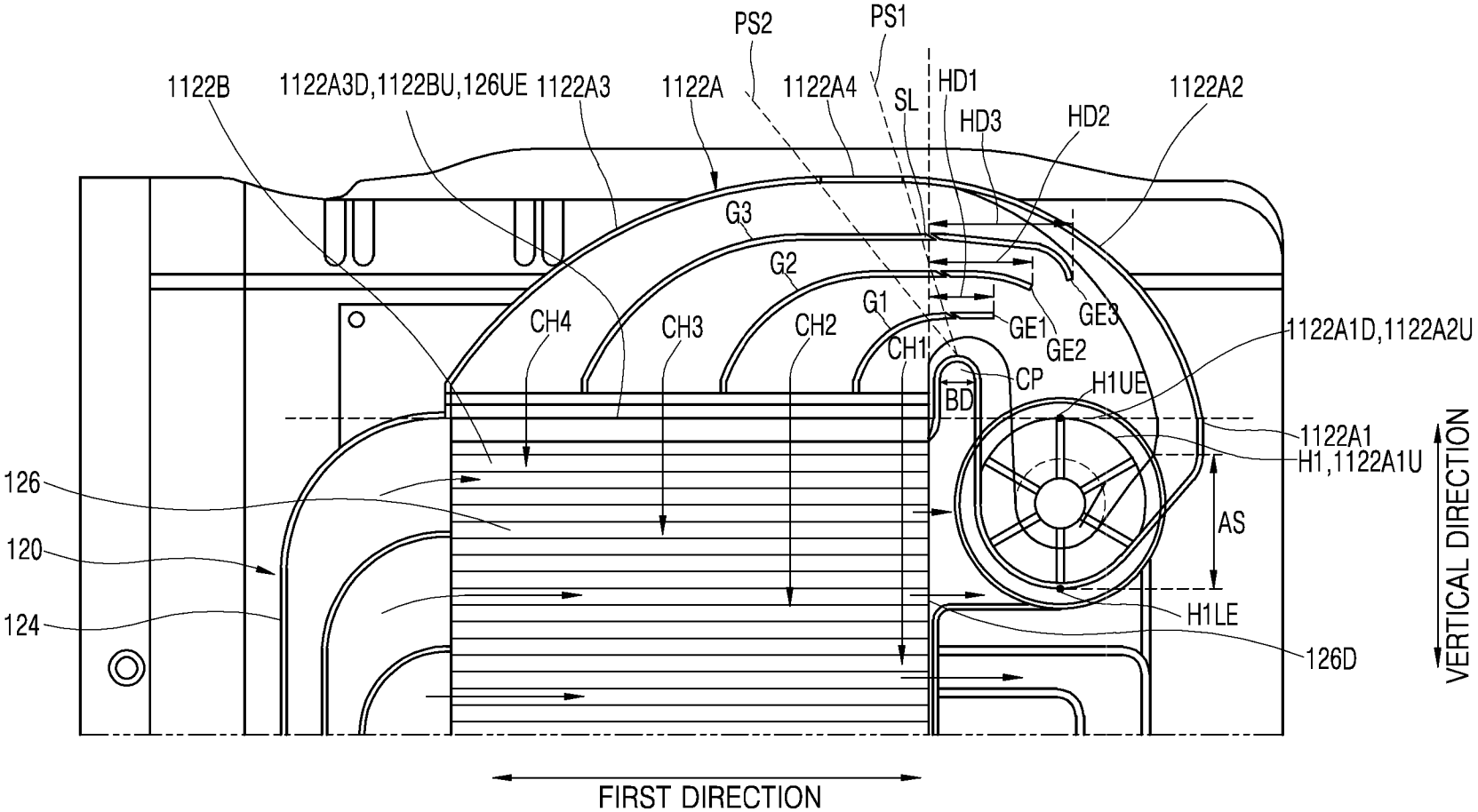
FIGS. 11 and 12 are enlarged views of the top side of FIG. 10.

A width BD of the concave portion CP defined by the bent inner surface of the upstream portion 1122A in the first direction may gradually decrease or remain the same toward an upper end UP of the bent inner surface of the upstream portion 1122A along upward direction (FIG. 11).

Therefore, based on the concave portion CP defined by the bent inner surface of the upstream portion 1122A, the ascending duct portion 1122A2 disposed at a side of the inlet port H1 and the descending duct portion 1122A3 disposed at a side of the heat exchange flow path part 126 may adjoin to or communicate with each other by becoming closer to each other without becoming distant in the middle. Therefore, a total width in the first direction of the upstream portion 1122A may decrease, and vertical lengths of the ascending duct portion 1122A2 and the descending duct portion 1122A3 may decrease. Therefore, since the length of the upstream portion 1122A decreases, a distance by which the air introduced into the upstream portion 1122A through the inlet port H1 flows to the heat exchange portion 1122B adjoining the heat exchange flow path part 126 may decrease. Therefore, the air flowing out of the tub 12 through the inlet port H1 may reach the heat exchange portion 1122B in a high-temperature state, which makes it possible to improve the heat transfer efficiency and reduce the flow resistance because the flow distance decreases. In addition, when a temperature of air is high, the amount of saturated water vapor significantly decreases as the temperature decreases. Therefore, a large amount of condensate water may be produced by cooling the high-temperature air in the heat exchange portion 1122B. Therefore, the drying efficiency and energy efficiency may be improved.

In addition, when the width BD in the first direction of the concave portion CP defined by the bent inner surface of the upstream portion 1122A gradually decreases along upward direction, the flow direction of the air along the bent inner surface may be slowly changed, thereby reducing the flow resistance.

In contrast, when the width BD of the concave portion CP defined by the bent inner surface of the upstream portion 1122A in the first direction increases along upward direction in a predetermined height section, the ascending duct portion 1122A2 and the descending duct portion 1122A3 become distant from each other along upward direction in the predetermined height section. However, the ascending duct portion 1122A2 and the descending duct portion 1122A3 need to become closer to each other (i.e. the width BD needs to decrease) along upward direction so that the upstream portion 1122A has a bent shape and the ascending duct portion 1122A2 and the descending duct portion 1122A3 are smoothly connected. Therefore, the ascending duct portion 1122A2 and the descending duct portion 1122A3 need to extend in the upward direction at least by a height (length in the vertical direction) made by summing up a height of the predetermined height section and a height of a height section in which the ascending duct portion 1122A2 and the descending duct portion 1122A3 become close to each other (i.e. the width BD decrease) along the upward direction. Therefore, the length of the vertical extension component may increase. For this reason, the length of the upstream portion 1122A may increase, and the drying efficiency and energy efficiency may decrease.

The upstream portion 1122A may include an inflow portion 1122A1, an ascending duct portion 1122A2, and a descending duct portion 1122A3.

The inflow portion 1122A1 may face the inlet port H1. In addition, the upstream end 1122A1U of the inflow portion 1122A1 may communicate with the inlet port H1.

The inflow portion 1122A1 may extend to a height of the upper end H1UE of the inlet port H1 and be opened upward. A downstream end 1122A1D of the inflow portion 1122A1 may be coupled directly to the ascending duct portion 1122A2.

The inflow portion 1122A1 may discharge the moist air, which is introduced into the inflow portion 1122A1 through the inlet port H1, to the ascending duct portion 1122A2.

The inflow portion 1122A1 may include a section AS in which the cross-sectional area increases upward.

Therefore, even though a width in the second direction of the inflow portion 1122A1 is small, the flow direction of the air introduced into the inflow portion 1122A1 through the inlet port H1 may be easily changed from the second direction into a vertically upward direction or into an upward direction inclined toward one side in the first direction without great flow resistance. Therefore, the air in the inflow portion 1122A1 may stably flow to the ascending duct portion 1122A2 provided at the upper side of the inflow portion 1122A1. Therefore, the drying efficiency and energy efficiency may be improved.

In at least a part of the section AS, the inflow portion 1122A1 may be further expanded toward the other side in the first direction than the other end in the first direction of the inlet port H1.

Therefore, the width of the inflow portion 1122A1 increases, which makes it possible to reduce the flow resistance. Therefore, the drying efficiency and energy efficiency may be improved.

In addition, as described below, when the heat exchange flow path part 126 is disposed at one side in the first direction of the inlet port H1, the inflow portion 1122A1 facing the inlet port H1 is expanded toward the other side in the first direction away from the heat exchange flow path part 126, and thus the heat exchange flow path part 126 may be expanded toward one side in the first direction to a point close to the inlet port H1. Therefore, the contact area between the heat exchange flow path part 126 and the heat exchange portion 1122B may increase, thereby improving the heat transfer efficiency. In addition, the heat exchange flow path part 126 may be disposed close to the inlet port H1 in the first direction. Therefore, when the downstream end 126D of the heat exchange flow path part 126 is opened toward the upstream portion 1122A, the cold air in the heat exchange flow path part 126 may be discharged toward the upstream portion 1122A disposed close to the heat exchange flow path part 126. Therefore, as the upstream portion 1122A comes into contact with the cold air, the condensate water may be effectively produced in the upstream portion 1122A and discharged to the outside. Therefore, the drying performance may be improved. In this regard, this configuration will be described.

The ascending duct portion 1122A2 may extend from the upper end (the downstream end 1122A1D) of the inflow portion 1122A1. That is, an upstream end 1122A2U of the ascending duct portion 1122A2 may be coupled directly to the upper end (downstream end 1122A1D) of the inflow portion 1122A1.

The ascending duct portion 1122A2 may extend in a vertically upward direction or an upward direction inclined toward one side in the first direction. In this case, one side in the first direction may mean the front side or the rear side (the front side in the drawings). Therefore, the air may ascend in the ascending duct portion 1122A1.

The ascending duct portion 1122A2 may not extend in the upward direction inclined toward the other side in the first direction.

Therefore, as described below, when the heat exchange flow path part 126 is disposed at one side in the first direction of the inlet port H1, the ascending duct portion 1122A2 extends only toward one side in the first direction, which is a direction approaching the heat exchange flow path part 126 in the first direction. Therefore, the length of the upstream portion 1122A for connecting the inlet port H1 and the heat exchange portion 1122B adjoining the heat exchange flow path part 126 may decrease. Therefore, the drying efficiency and energy efficiency may be improved.

However, when the ascending duct portion 1122A2 extended in the inclined upward direction, the ascending duct portion 1122A2 need not extend necessarily only toward one side in the first direction. Therefore, the ascending duct portion 1122A2 may not only extend toward one side in the first direction, but also extend in the upward direction inclined toward the other side in the first direction.

The downstream end of the ascending duct portion 1122A2 may communicate with the upstream end of the descending duct portion 1122A3.

The ascending duct portion 1122A2 may discharge the moist air, which is introduced from the inflow portion 1122A1, to the descending duct portion 1122A3. In addition, the ascending duct portion 1122A2 may allow the water, which is introduced into the ascending duct portion 1122A2 through the inlet port H1, to flow to the inflow portion 1122A1 by its own weight, thereby preventing the water from being introduced into the condensing duct 112.

The descending duct portion 1122A3 may be disposed between the ascending duct portion 1122A2 and the heat exchange portion 1122B. The upstream end of the descending duct portion 1122A3 may communicate with the downstream end of the ascending duct portion 1122A2. The downstream end 1122A3D of the descending duct portion 1122A3 may communicate with an upstream end 1122BU of the heat exchange portion 1122B. For example, the downstream end 1122A3D of the descending duct portion 1122A3 may be coupled directly to the upstream end 1122BU of the heat exchange portion 1122B.

The descending duct portion 1122A3 may extend in a vertically downward direction or a downward direction inclined toward one side in the first direction. In this case, one side in the first direction may mean the front side or the rear side. Therefore, the air may descend in the descending duct portion 1122A3.

The descending duct portion 1122A3 may not extend in the downward direction inclined toward the other side in the first direction.

Therefore, as described below, when the heat exchange flow path part 126 is disposed at one side in the first direction of the inlet port H1, the descending duct portion 1122A3 extends only toward one side in the first direction, which is a direction approaching the heat exchange flow path part 126 in the first direction. Therefore, the length of the upstream portion 1122A for connecting the inlet port H1 and the heat exchange portion 1122B adjoining the heat exchange flow path part 126 may decrease. Therefore, the drying efficiency and energy efficiency may be improved.

However, when the descending duct portion 1122A3 extends in the inclined downward direction, the descending duct portion 1122A3 need not extend necessarily only toward one side in the first direction. Therefore, the descending duct portion 1122A3 may not only extend toward one side in the first direction, but also extend in the downward direction inclined toward the other side in the first direction.

The descending duct portion 1122A3 may discharge the moist air, which is introduced from the ascending duct portion 1122A2, to the heat exchange portion 1122B. Since the descending duct portion 1122A3 descends the air, the upstream portion 1122A may be connected to the heat exchange portion 1122B which is connected to the upstream portion 1122A through the descending duct portion 1122A3 and extends downward.

Meanwhile, the horizontal duct portion 1122A4 may be interposed between the ascending duct portion 1122A2 and the descending duct portion 1122A3. The horizontal duct portion 1122A4 may extend in the first direction and communicate with the ascending duct portion 1122A2 and the descending duct portion 1122A3.

The horizontal duct portion 1122A4 makes the air having ascended in the ascending duct portion 1122A2 flows for a time in the first direction (horizontal direction) before descending in the descending duct portion 1122A3, thus preventing the flow direction of the air from being rapidly changed. Therefore, the flow resistance may be reduced, and the drying efficiency and energy efficiency may be improved.

The ascending duct portion 1122A2 and the horizontal duct portion 1122A4 may be separated by an imaginary first surface PS1, and the descending duct portion 1122A3 and the horizontal duct portion 1122A4 may be separated by an imaginary second surface PS2.

As described above, the upstream portion 1122A includes: the inflow portion 1122A1 facing the inlet port H1, extending to the height of the upper end H1UE of the inlet port H1, and opened upward; the ascending duct portion 1122A2 extending from the upper end (downstream end 1122A1D) of the inflow portion 1122A1 and extending in the vertically upward direction or the upward direction inclined toward one side in the first direction; and the descending duct portion 1122A3 having the upstream end communicating with the downstream end of the ascending duct portion 1122A2, extending in the vertically downward direction or the downward direction inclined toward one side in the first direction, and having the downstream end 1122A3D communicating with the heat exchange portion 1122B. Therefore, it is possible to simply configure the upstream portion 1122A curvedly extending from the upstream end to allow the air to ascend and then descend therein. Further, the length of the upstream portion 1122A may decrease. Therefore, the manufacturing and management costs may be reduced, and the drying efficiency and energy efficiency may be improved.

The upstream portion 1122A may have one or more guides G1, G2, and G3 protruding in the second direction and extending in a longitudinal direction of the upstream portion 1122A.

Therefore, the flow direction of the air may be stably changed along the one or more guides G1, G2, and G3 in the upstream portion 1122A, which makes it possible to reduce the flow resistance and improve the drying efficiency and energy efficiency.

In addition, the air flowing in the upstream portion 1122A may be appropriately distributed in the width direction by the one or more guides G1, G2, and G3 without being concentrated on any one side in the width direction of the upstream portion 1122A. Therefore, the flow resistance in the upstream portion 1122A may be reduced, and the drying efficiency and energy efficiency may be improved. In addition, since the air in the upstream portion 1122A may be distributed in the width direction and introduced into the heat exchange portion 1122B, the air may uniformly flow in the width direction in the heat exchange portion 1122B, and the turbulent flow may not occur. Therefore, the heat exchange may be uniformly performed in a wide area, which makes it possible to improve the heat transfer efficiency and reduce the flow resistance. Therefore, the drying efficiency and energy efficiency may be improved.

The guide may be a vane.

Therefore, the parts of the air appropriately distributed in the width direction by the one or more guides G1, G2, and G3 may not be mixed in the upstream portion 1122A. Therefore, the flow direction of the air may be more stably changed along the one or more guides G1, G2, and G3, and the flow resistance may be reduced, which makes it possible to further improve the drying efficiency and energy efficiency. In addition, since the air in the upstream portion 1122A may be introduced into the heat exchange portion 1122B in the state in which the air is appropriately distributed in the width direction, the air may uniformly flow in the width direction in the heat exchange portion 1122B, and the turbulent flow may not occur. Therefore, the heat exchange may be uniformly performed in a wide area, which makes it possible to improve the heat transfer efficiency and reduce the flow resistance. Therefore, the drying efficiency and energy efficiency may be improved.

In the upstream portion 1122A, the plurality of guides G1, G2, and G3 may be disposed to be spaced apart from one another at predetermined intervals. Therefore, in the upstream portion 1122A, a plurality of flow paths CH1, CH2, CH3, and CH4 may be formed by the plurality of guides G1, G2, and G3 (FIG. 11). The plurality of guides G1, G2, and G3 may be disposed to be spaced apart from one another in the vertical direction.

Since the upstream portion 1122A curvedly extends, the flow paths CH1, CH2, CH3, and CH4 may include a curved inner flow path (e.g., CH1) and a curved outer flow path (e.g., CH4). The inner flow path (e.g., CH1) may be defined by the guide (e.g., G1) positioned at the lower side, and the outer flow path (e.g., CH4) may be defined by the guide (e.g., G3) positioned at the upper side.

A length of the inner flow path (e.g., CH1) may be shorter than a length of the outer flow path (e.g., CH4). Therefore, because the inner flow path (e.g., CH1) is generally closer to the fan 130 than is the outer flow path (e.g., CH4), a higher pressure (e.g., negative pressure) is applied to the inner flow path (e.g., CH1) than to the outer flow path (e.g., CH4), such that a large amount of air may be introduced into the inner flow path (e.g., CH1) and flow. Therefore, because the air flowing in the upstream portion 1122A is concentrated on the inner flow path (e.g., CH1), the air cannot be appropriately distributed in the width direction. The following configuration may solve this problem.

As the guide is positioned at the upper side, first direction distance HD1, HD2, or HD3 from the heat exchange flow path part 126 to an upstream end GE1, GE2, or GE3 of the guide G1, G2, or G3 may increase (FIG. 11). In this case, the upstream ends GE1, GE2, and GE3 of the guides G1, G2, and G3 may correspond to ends GE1, GE2, and GE3 of the guides G1, G2, and G3 adjacent to the inlet port H1.

Therefore, the guide (e.g., G3) positioned at the upper side may further extend and protrude toward the inlet port H1 in the first direction than the guide (e.g., G1) positioned at the lower side. Therefore, even though the air in the upstream portion 1122A receives a higher pressure (e.g., negative pressure) from the inner flow path (e.g., CH1) than from the outer flow path (e.g., CH4), the air is caught by the guide (e.g., G3) positioned at the upper side and introduced into the outer flow path (e.g., CH4) first before being introduced into the inner flow path (e.g., CH1). Therefore, the air may be uniformly distributed in the width direction in the upstream portion 1122A, which makes it possible to improve the drying efficiency and energy efficiency.

Meanwhile, when high-temperature and humid air flowing out of the tub 12 through the inlet port H1 is introduced into the comparatively low-temperature upstream portion 1122A, the condensate water may be produced in the upstream portion 1122A. The condensate water flows along surfaces of the one or more guides G1, G2, and G3 and is introduced into the condensing duct 112, which may cause a deterioration in drying performance. The following configuration may solve this problem.

A slit SL may be formed in the guide. The slit SL may extend in the second direction.

Therefore, the condensate water produced in the upstream portion 1122A flows along the one or more guides G1, G2, and G3 first. When the condensate water meets the slit SL, the condensate water penetrates the one or more guides G1, G2, and G3 through the slits SL and flows downward, and finally, the condensate water may be discharged to the outside of the upstream portion 1122A. For example, the condensate water may flow downward through the slits SL and be discharged to the outside of the upstream portion 1122A through the inlet port H1. Therefore, the condensate water produced in the upstream portion 1122A is not introduced into the condensing duct 112, which makes it possible to improve the drying performance.

Figure 12:
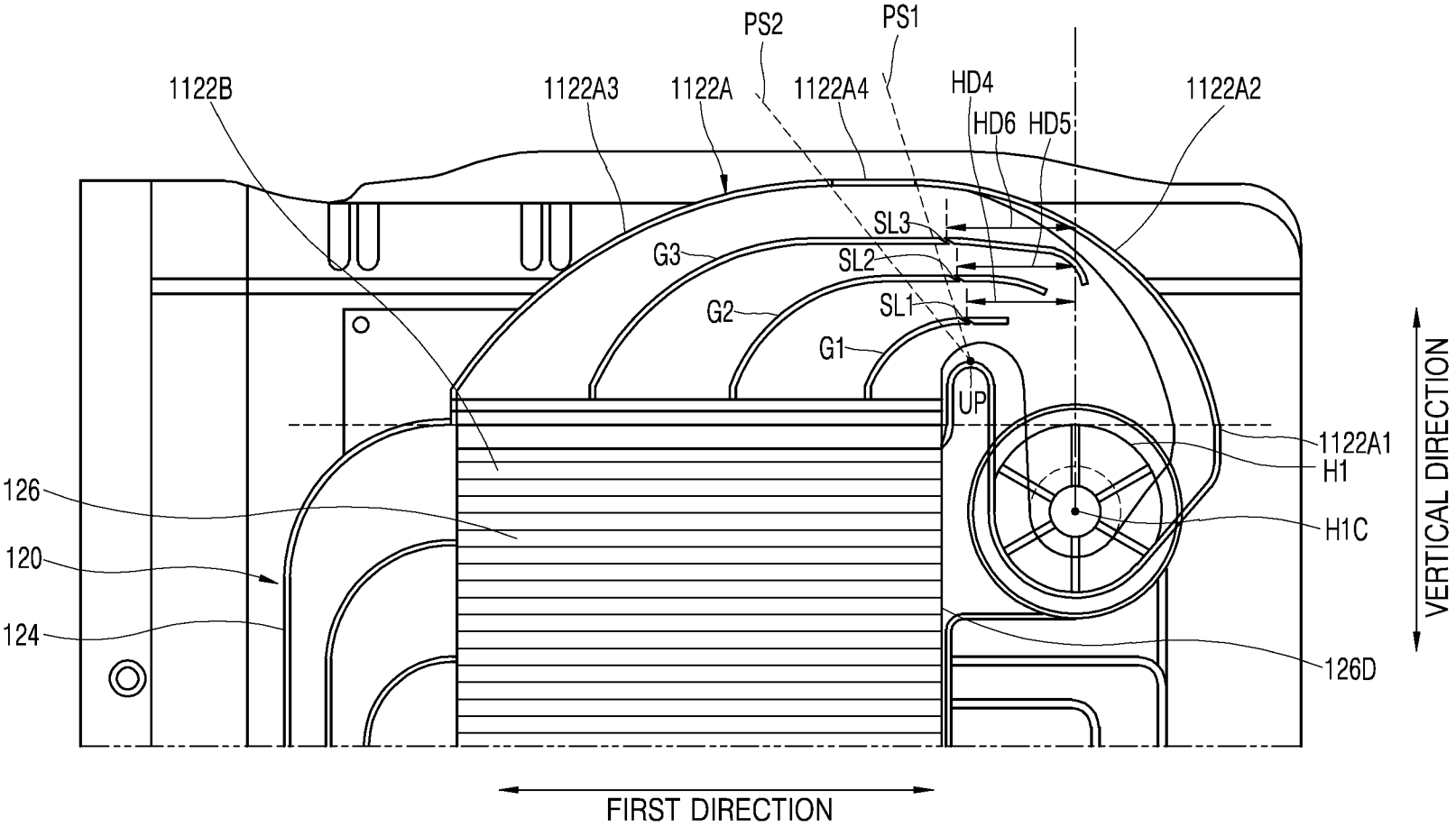
Figure 13:
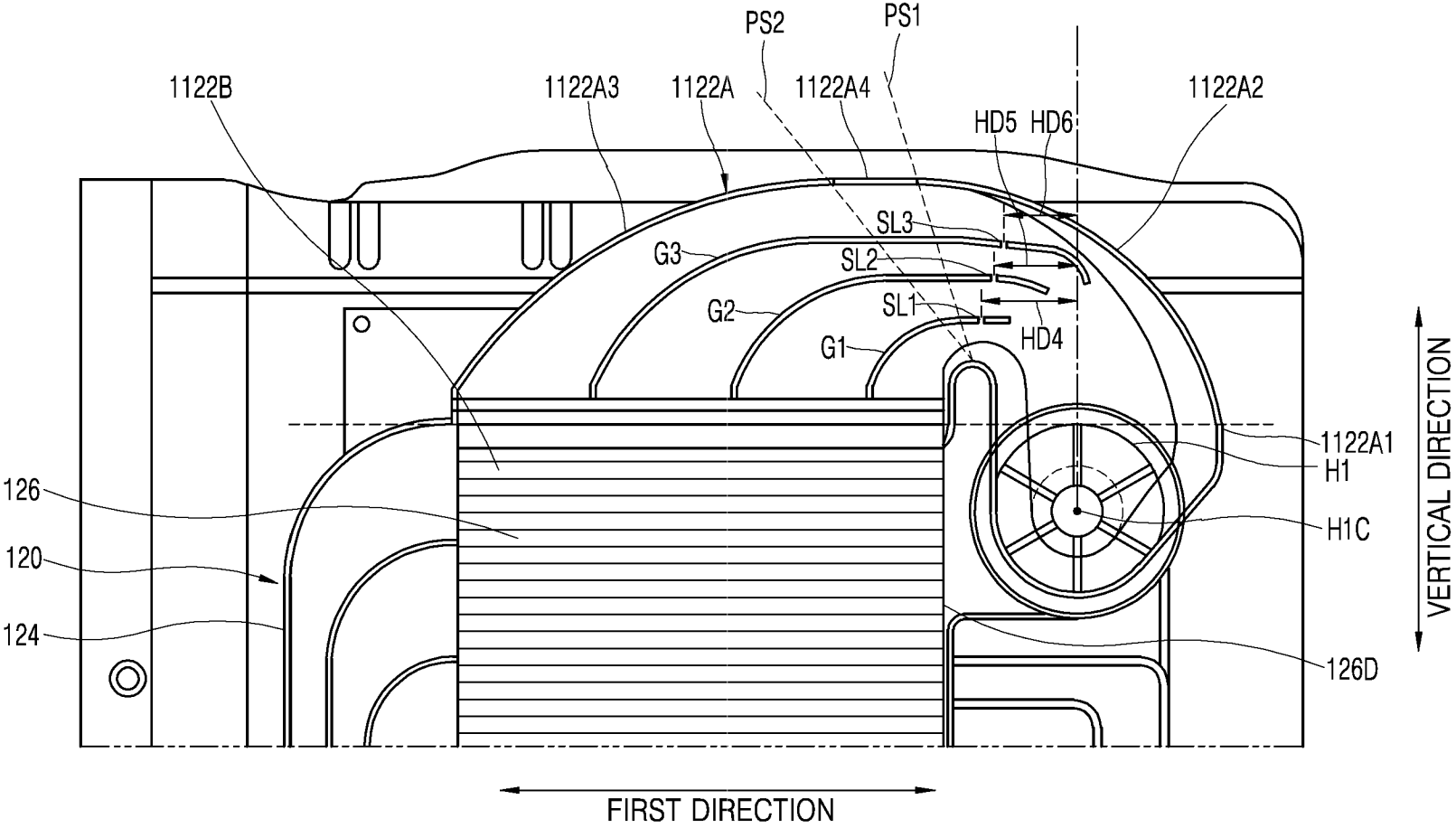
FIG. 13 is a view illustrating a state in which a position of a slit illustrated in FIG. 12 is changed.

The slit SL may be inclined downwardly in a direction becoming closer to the center H1C of the inlet port H1 (FIG. 12). For example, the slit SL may be inclined downward toward the other side close to the center H1C of the inlet port H1 between one side and the other side in the first direction.

Therefore, the position of the slit SL on the upper surface of the guide G1, G2, or G3 may be more distant from the inlet port H1 than the position of the slit SL on the lower surface of the guide G1, G2, or G3 by a difference value between the positions (the positions on the upper surface and the lower surface). Therefore, the condensate water, which is produced at the point distant from the inlet port H1 by the difference value between the positions, may also be discharged through the slits SL, which makes it possible to improve the drying performance.

In addition, the position of the slit SL on the lower surface of the guide G1, G2, or G3 may be closer to the inlet port H1 than the position of the slit SL on the upper surface of the guides G1, G2, or G3 by the difference value between the positions (the positions on the upper surface and the lower surface). Therefore, the condensate water passing through the slit SL may quickly and easily reach the inlet port H1 and be discharged to the outside of the upstream portion 1122A through the inlet port H1, which makes it possible to improve the drying performance.

In addition, when the condensate water passes through the slit SL, the condensate water gets closer to the inlet port H1 by the difference value between the positions of the slit SL on the upper surface and the lower surface of the guide G1, G2, or G3 in accordance with the inclination of the slit SL. Therefore, as described below, when the slits SL1, SL2, and SL3 are respectively formed in the plurality of guides G1, G2, and G3 disposed to be spaced apart from one another at predetermined intervals in the vertical direction, the slits SL1, SL2, and SL3 may be formed such that as the guides G1, G2, and G3 are positioned at the upper side, first direction distances HD4, HD5, and HD6 from the center H1C of the inlet port H1 to the slits SL increase. Therefore, as the guides G1, G2, and G3 are positioned at the upper side, even the condensate water produced at the point distant from the inlet port H1 may be discharged through the slits SL1, SL2, and SL3 formed in the guides G1, G2, and G3, which makes it possible to improve the drying performance.

However, the present disclosure is not limited to this configuration. Therefore, the slit SL may be formed in the vertical direction without being inclined as illustrated in FIG. 13.

The slits SL1, SL2, and SL3 may be respectively formed in the plurality of guides G1, G2, and G3 disposed to be spaced apart from one another at predetermined intervals in the vertical direction.

As the guide G1, G2, or G3 is positioned at the upper side, the first direction distance HD4, HD5, or HD6 from the center H1C of the inlet port H1 to the slit SL1, SL2, or SL3 may increase (FIGS. 10 to 12).

In addition, as the guide G1, G2, or G3 is positioned at the upper side, the first direction distance HD4, HD5, or HD6 from the center H1C of the inlet port H1 to the slit SL1, SL2, or SL3 may decrease (FIG. 13).

Therefore, the condensate water, which flows downward through the slit (e.g., SL3) formed in the guide (e.g., G3) positioned at the upper side, may continuously flow downward through the slit (e.g., SL2) formed in the guide (e.g., G2) positioned at the lower side. Therefore, even though the plurality of guides G1, G2, and G3 is disposed vertically in the upstream portion 1122A, the condensate water produced in the upstream portion 1122A may flow downward while penetrating the plurality of guides G1, G2, and G3, and thus the condensate water may finally be discharged to the outside of the upstream portion 1122A. Therefore, the condensate water produced in the upstream portion 1122A is not introduced into the condensing duct 112, which makes it possible to improve the drying performance.

In addition, when the first direction distances HD4, HD5, and HD6 increase as the guides G1, G2, and G3 are positioned at the upper side, even the condensate water produced at the point distant from the inlet port H1 may be discharged through the slits SL1, SL2, and SL3 formed in the guides G1, G2, and G3 as the guides G1, G2, and G3 are positioned at the upper side, which makes it possible to improve the drying performance.

Whether the slits SL1, SL2, and SL3 are formed so that the first direction distances HD4, HD5, and HD6 increase as the guides G1, G2, and G3 are positioned at the upper side or whether the slits SL1, SL2, and SL3 are formed so that the first direction distances HD4, HD5, and HD6 decrease as the guides G1, G2, and G3 are positioned at the upper side, and the distance in the first direction between the slits SL1, SL2, and SL3 formed in the guides G1, G2, and G3 disposed adjacent to one another vertically, may be determined depending on at least one of a) gradients of the guides G1, G2, and G3 at the periphery of the points at which the slits SL1, SL2, and SL3 are formed, b) gradients of the slits SL1, SL2, and SL3, and c) a flow velocity of the air.

The configuration a) will be described below.

For example, when all of the guides G1, G2, and G3 at the periphery of the points at which the slits SL1, SL2, and SL3 are formed are inclined downward toward the inlet port H1, the condensate water naturally flows toward the inlet port H1. Therefore, the slits SL1, SL2, and SL3 may be formed so that the first direction distances HD4, HD5, and HD6 increase as the guides G1, G2, and G3 are positioned at the upper side. Therefore, the condensate water may continuously pass through the slits SL1, SL2, and SL3. In this case, if the gradients of the guides G1, G2, and G3 at the periphery of the points at which the slits SL1, SL2, and SL3 are formed are large, the distance in the first direction between the slits SL1, SL2, and SL3 formed in the guides G1, G2, and G3 disposed adjacent to one another vertically may increase.

The configuration b) will be described below.

When the slits SL1, SL2, and SL3 are inclined downwardly in the direction becoming closer to the center H1C of the inlet port H1 as described above and the condensate water passes through the slits SL1, SL2, and SL3, the condensate water become closer to the inlet port H1 by the difference value between the positions of the slits SL1, SL2, and SL3 on the upper surface and the lower surface of the guides G1, G2, and G3 in accordance with the inclination of the slits SL1, SL2, and SL3. Therefore, to allow the condensate water to continuously pass through the slits SL1, SL2, and SL3, the slits SL1, SL2, and SL3 need to be formed such that the first direction distances HD4, HD5, and HD6 increase as the guides G1, G2, and G3 are positioned at the upper side (FIG. 12).

The configuration c) will be described below.

When the flow velocity of the air flowing from the inlet port H1 to the heat exchange portion 1122B is high, the condensate water may naturally flow toward the heat exchange portion 1122B by the airflow when the condensate water flows along the guides G1, G2, and G3 or flows downward while passing through the slits SL1, SL2, and SL3. Therefore, the slits SL1, SL2, and SL3 may be formed such that the first direction distances HD4, HD5, and HD6 decrease as the guides G1, G2, and G3 are positioned at the upper side. Therefore, the condensate water may continuously pass through the slits SL1, SL2, and SL3 (FIG. 13). In this case, when the flow velocity of the air is high, the distance in the first direction between the slits SL1, SL2, and SL3 formed in the guides G1, G2, and G3 disposed adjacent to one another vertically may increase.

The slit SL1, SL2, or SL3 formed in the guide G1, G2, or G3, which is positioned at the lowest portion among the guides G1, G2, and G3, may be positioned in a vertically upward direction or in an upward direction inclined toward the other side in the first direction from the upper end UP (FIG. 12) of the bent inner surface of the upstream portion 1122A.

Therefore, since the condensate water produced in the upstream portion 1122A continuously passes through the slits SL1, SL2, and SL3 and then finally flows to the lower end (upstream end 1122A2U) of the ascending duct portion 1122A2, the condensate water may be discharged to the outside of the upstream portion 1122A. For example, the condensate water may be discharged to the outside of the upstream portion 1122A through the inlet port H1 formed in the lower portion of the ascending duct portion 1122A2. Therefore, the condensate water produced in the upstream portion 1122A is not introduced into the condensing duct 112, which makes it possible to improve the drying performance.

The heat exchange portion 1122B may be connected to the upstream portion 1122A and extend downward.

Specifically, the upstream end 1122BU of the heat exchange portion 1122B may communicate with the downstream end 1122A3D of the upstream portion 1122A and extend downward from the upstream end 1122BU. In this case, the downward direction may mean the vertically downward direction or the inclined downward direction. Therefore, the air may approximately descend in the heat exchange portion 1122B.

Since the heat exchange portion 1122B extends downward as described above, the water condensed in the heat exchange portion 1122B may fall or flow downward by gravity, such that the condensate water may be easily collected and quickly discharged to the outside. Therefore, the drying efficiency may be improved.

Meanwhile, since the air in the drying device 100 needs to flow from the inlet port H1 to the outlet port H2 formed lower than the inlet port H1, the route through which the air flows downward is an essential route for the drying duct 110 and an optimal route that reduces the length of the drying duct 110.

The heat exchange portion 1122B extends downward, which makes it possible to provide the essential and optimal route. Therefore, when the drying duct 110 includes the heat exchange portion 1122B, the length of the drying duct 110 decreases, and the flow resistance is reduced, which makes it possible to improve the drying efficiency and energy efficiency.

The heat exchange portion 1122B may adjoin the heat exchange flow path part 126 of the cold air supply module 120. The downstream end of the heat exchange portion 1122B may communicate with the upstream end of the downstream portion 1122C.

The heat exchange portion 1122B may extend from the downstream end 1122A3D of the upstream portion 1122A. That is, the heat exchange portion 1122B may be coupled directly to the upstream portion 1122A.

In this case, gradients of the two opposite surfaces in the first direction at the downstream end 1122A3D of the upstream portion 1122A may correspond to gradients of the two opposite surfaces in the first direction at the upstream end 1122BU of the heat exchange portion 1122B.

Therefore, the flow direction of the air at the downstream end 1122A3D of the upstream portion 1122A corresponds to the extension direction at the upstream end 1122BU of the heat exchange portion 1122B before the air in the upstream portion 1122A is introduced into the heat exchange portion 1122B. Therefore, the air may flow in the extension direction of the heat exchange portion 1122B in the heat exchange portion 1122B and be comparatively uniformly dispersed in the width direction, and the turbulent flow may not occur. Therefore, the heat exchange may be uniformly performed in a wide area, which makes it possible to improve the heat transfer efficiency and reduce the flow resistance. Therefore, the drying efficiency and energy efficiency may be improved.

In this case, if a) the descending duct portion 1122A3 extends in the upstream portion 1122A to a height which is not small, and if b) the gradient of the two opposite surfaces in the first direction of the descending duct portion 1122A3 is gradually changed to the gradient of the two opposite surfaces in the first direction at the upstream end 1122BU of the heat exchange portion 1122B in the extension direction of the upstream portion 1122A, the flow direction of most of the air in the descending duct portion 1122A3 may be slowly and stably changed to the extension direction at the upstream end 1122BU of the heat exchange portion 1122B. Therefore, the air in the heat exchange portion 1122B stably flows in the extension direction of the heat exchange portion 1122B and be uniformly dispersed in the width direction, and the turbulent flow may not occur. Therefore, the heat transfer efficiency may be improved, and the flow resistance may be reduced, which makes it possible to improve the drying efficiency and energy efficiency.

In contrast, for example, if the height (a total length of the vertical extension component) of the descending duct portion 1122A3 is small, the flow direction of only a part of the air in the descending duct portion 1122A3 may be changed to the extension direction at the upstream end 1122BU of the heat exchange portion 1122B. Therefore, the air in the heat exchange portion 1122B cannot stably flow in the extension direction of the heat exchange portion 1122B and cannot be uniformly dispersed in the width direction, and the turbulent flow may occur. Therefore, the heat transfer efficiency deteriorates, and the flow resistance is significantly increased, which may cause a deterioration in drying efficiency and energy efficiency.

As described above, the cold air supply module 120 may include the heat exchange flow path part 126.

The heat exchange flow path part 126 may adjoin the heat exchange portion 1122B.

The heat exchange flow path part 126 may be disposed at one side in the first direction of the inlet port H1. A height of an upper end 126UE of the heat exchange flow path part 126 may be equal to or larger than a height of a lower end H1LE of the inlet port H1.

Therefore, the heat exchange portion 1122B adjoining the heat exchange flow path part 126 may also be disposed at one side in the first direction of the inlet port H. In addition, a height of an upper end (upstream end 1122BU) of the heat exchange portion 1122B adjoining the heat exchange flow path part 126 may also be equal to or larger than the height of the lower end H1LE of the inlet port H1.

In this case, one side in the first direction may mean the front side or the rear side.

Therefore, the length of the upstream portion 1122A for connecting the inlet port H1 and the heat exchange portion 1122B adjoining the heat exchange flow path part 126 may decrease. The upstream portion 1122A is divided into a first direction extension component and a vertical extension component (in the upward or downward direction), and the extension components will be described.

1) The upstream portion 1122A needs to have the first direction extension component because the heat exchange flow path part 126 needs to be disposed at one side in the first direction of the inlet port H1 and the upstream portion 1122A needs to connect the inlet port H1 and the heat exchange portion 1122B adjoining the heat exchange flow path part 126. The first direction extension component may be repeatedly used as the first direction extension component for allowing the upstream portion 1122A to be bent to ascend and then descend. Therefore, the length of the upstream portion 1122A may decrease.

In contrast, when the heat exchange flow path part 126 is disposed in the vertically downward direction of the inlet port H1, the upstream portion 1122A needs to have the first direction extension component so that the upstream portion 1122A is bent to ascend and then descend. Further, the upstream portion 1122A needs to have the first direction extension component so as to be connected to the heat exchange portion 1122B adjoining the heat exchange flow path part 126 disposed in the vertically downward direction of the inlet port H1. Therefore, the length of the upstream portion 1122A may increase.

2) The upstream portion 1122A may have an upward extension component (ascending duct portion) bent to ascend and then descend. When the height of the upper end 126UE of the heat exchange flow path part 126 is equal to or larger than the height of the lower end H1LE of the inlet port H1, the upstream portion 1122A may have a downward extension component (descending duct portion) having a comparatively short length to connect the upper end (downstream end) of the upward extension component (ascending duct portion) and the upstream end 1122BU of the heat exchange portion 1122B adjoining the heat exchange flow path part 126. Therefore, the length of the upstream portion 1122A may decrease.

In contrast, when the heat exchange flow path part 126 is disposed below the inlet port H1, the upstream portion 1122A needs to have the upward extension component so as to be bent to ascend, and the upstream portion 1122A needs to have the downward extension component having a length comparatively long to the height of the upstream end 1122BU of the heat exchange portion 1122B to connect the upper end of the upward extension component (ascending duct portion) and the upstream end 1122BU of the heat exchange portion 1122B positioned below the inlet port H1 and adjoining the heat exchange flow path part 126. Therefore, the length of the upstream portion 1122A may increase.

The length of the upstream portion 1122A decreases when the heat exchange flow path part 126 is disposed at one side in the first direction of the inlet port H1 and the height of the upper end 126UE of the heat exchange flow path part 126 is equal to or larger than the height of the lower end H1LE of the inlet port H1 as described above. Therefore, the distance by which the air introduced into the upstream portion 1122A through the inlet port H1 flows to the heat exchange portion 1122B adjoining the heat exchange flow path part 126 may decrease. Therefore, the air flowing out of the tub 12 through the inlet port H1 may reach the heat exchange portion 1122B in a high-temperature state, which makes it possible to improve the heat transfer efficiency and reduce the flow resistance because the flow distance decreases. In addition, when a temperature of air is high, the amount of saturated water vapor significantly decreases as the temperature decreases. Therefore, a large amount of condensate water may be produced by cooling the high-temperature air in the heat exchange portion 1122B. Therefore, the drying efficiency and energy efficiency may be improved.

In addition, the heat exchange flow path part 126 may be expanded to the height at which the inlet port H1 is formed. In particular, when the inlet port H1 is formed in the upper portion of one sidewall 12R of the tub 12, the heat exchange flow path part 126 may be expanded to the upper portion of one sidewall 12R of the tub 12. Therefore, the contact area between the heat exchange flow path part 126 and the heat exchange portion 1122B may increase, thereby improving the heat transfer efficiency. Therefore, the drying efficiency and energy efficiency may be improved.

In addition, the downstream end 126D of the heat exchange flow path part 126 may face the upstream portion 1122A. Specifically, for example, the downstream end 126D of the heat exchange flow path part 126 may face the portion (inflow portion 1122A1) of the upstream portion 1122A facing the inlet port H1 and/or a portion (ascending duct portion 1122A2) extending in the vertically upward direction or the inclined upward direction. Therefore, when the downstream end 126D of the heat exchange flow path part 126 is opened toward the upstream portion 1122A, the cold air in the heat exchange flow path part 126 may be discharged toward the upstream portion 1122A. Therefore, as the upstream portion 1122A comes into contact with the cold air, the condensate water may be produced in the upstream portion 1122A and discharged to the outside. Therefore, the drying performance may be improved. In this regard, this configuration will be described.

Meanwhile, when the heat exchange flow path part 126 disposed above the inlet port H1, the heat exchange flow path part 126 protrudes from the upper end of the tub 12. For this reason, the dishwasher cannot be miniaturized, and the aesthetic appearance of the dishwasher may deteriorate. If the position of the inlet port H1 is lowered to prevent the heat exchange flow path part 126 from protruding upward, the efficiency in circulating the air in the tub 12 deteriorates, which may cause a deterioration in drying performance. In addition, if the heat exchange flow path part 126 is disposed above the inlet port H1, the heat exchange portion 1122B adjoining the heat exchange flow path part 126 needs to be disposed higher than the inlet port H1. For this reason, the length of the condensing duct 112 increases, and the flow resistance increases, which may cause a deterioration in drying performance. Therefore, the heat exchange flow path part 126 need not be disposed above the inlet port H1.

The height of the upper end 126UE of the heat exchange flow path part 126 may be equal to or smaller than the height of the upper end H1UE of the inlet port H1. Therefore, the height of the upper end (upstream end 1122BU) of the heat exchange portion 1122B adjoining the heat exchange flow path part 126 may also be equal to or smaller than the height of the upper end H1UE of the inlet port H1.

The height of the upper end (upstream end 1122BU) of the heat exchange portion 1122B may correspond to the height of the lower end (downstream end 1122A3D) of the descending duct portion 1122A3, and the height of the upper end H1UE of the inlet port H1 may correspond to the height of the lower end (upstream end 1122A2U) of the ascending duct portion 1122A2. Therefore, when the height (position) of the upper end 126UE of the heat exchange flow path part 126 is equal to or smaller than the height (position) of the upper end H1UE of the inlet port H1, the height of the lower end (downstream end 1122A3D) of the descending duct portion 1122A3 may be equal to or smaller than the height of the lower end (upstream end 1122A2U) of the ascending duct portion 1122A2.

The ascending duct portion 1122A2 needs to at least extend in the vertically upward direction or the inclined upward direction from the height of the upper end H1UE of the inlet port H1, i.e., the height (position) of the lower end (upstream end 1122A2U) of the ascending duct portion 1122A2 to the height at which a) the water is hardly introduced into the condensing duct 112, and b) the flow resistance does not significantly increase when the flow direction of the air changes from the vertical direction to the first direction. In addition, the ascending duct portion 1122A2 needs to at least extend in the vertically upward direction or the inclined upward direction from the height of the upper end H1UE of the inlet port H1, i.e., the height (position) of the lower end (upstream end 1122A2U) of the ascending duct portion 1122A2 c) to the height of the upper end (upstream end) of the descending duct portion 1122A3.

In this case, the height of the upper end (upstream end) of the descending duct portion 1122A3 may be a value made by summing up a height (a total length of the vertical extension component, vertical length) of the descending duct portion 1122A3 at the height (position) of the upper end 126UE of the heat exchange flow path part 126, i.e., the height (position) of the lower end (downstream end 1122A3D) of the descending duct portion 1122A3. The height (vertical length) of the descending duct portion 1122A3 is a height at which c1) the flow resistance does not significantly increase when the flow direction of the air in the descending duct portion 1122A3 changes from the first direction to the vertical direction, and c2) the flow direction of most of air in the descending duct portion 1122A3 may be slowly and stably changed in the extension direction at the upstream end 1122BU of the heat exchange portion 1122B.

When the height of the lower end (downstream end 1122A3D) of the descending duct portion 1122A3 is equal to or smaller than the height of the lower end (upstream end 1122A2U) of the ascending duct portion 1122A2, the height (position) of the upper end (upstream end) of the descending duct portion 1122A3 of the condition c) that may satisfy the conditions c1) and c2) may become smaller. Therefore, the height (the total length of the vertical extension component) of the ascending duct portion 1122A2, which satisfies all the conditions a), b), and c), may decrease.

That is, when the height (position) of the upper end 126UE of the heat exchange flow path part 126 is equal to or smaller than the height (position) of the upper end H1UE of the inlet port H1, the height (vertical length) of the ascending duct portion 1122A2 may decrease. Therefore, the length of the upstream portion 1122A may decrease, and the drying efficiency and energy efficiency may be improved. In addition, the upstream portion 1122A need not protrude upward from the upper end of the tub 12 even though the inlet port H1 is formed in the upper portion of one sidewall 12R. Therefore, it is possible to miniaturize the dishwasher and improve the aesthetic appearance of the dishwasher. In addition, even though the height (vertical length) of the ascending duct portion 1122A2 is small, the water may not be introduced into the upstream portion 1122A, the flow resistance may be reduced, and the flow direction of the air in the descending duct portion 1122A3 may be stably changed to the extension direction of the heat exchange portion 1122B.

In contrast, when the height (position) of the upper end 126UE of the heat exchange flow path part 126 is larger than the height (position) of the upper end H1UE of the inlet port H1, the height (position) of the lower end (downstream end 1122A3D) of the descending duct portion 1122A3 may be larger than the height (position) of the lower end (upstream end 1122A2U) of the ascending duct portion 1122A2. Therefore, to satisfy the condition c), the ascending duct portion 1122A2 needs to further extend upward in the vertically upward direction or the inclined upward direction by a difference value between the height (position) of the upper end 126UE of the heat exchange flow path part 126 and the height (position) of the upper end H1UE of the inlet port H1, i.e., a difference value between the height (position) of the lower end (downstream end 1122A3D) of the descending duct portion 1122A3 and the height (position) of the lower end (upstream end 1122A2U) of the ascending duct portion 1122A2.

Therefore, since the height (the total length of the vertical extension component) of the ascending duct portion 1122A2 increases, the length of the upstream portion 1122A increases, and the drying efficiency and energy efficiency may deteriorate. Further, since the upstream portion 1122A protrudes upward from the upper end of the tub 12, the dishwasher cannot be miniaturized, and the aesthetic appearance of the dishwasher may deteriorate.

Therefore, the height of the upper end 126UE of the heat exchange flow path part 126 may be equal to or smaller than the height of the upper end H1UE of the inlet port H1.

Meanwhile, the height of the upper end 126UE of the heat exchange flow path part 126 may correspond to the height of the upper end H1UE of the inlet port H1.

Therefore, the heat exchange flow path part 126 may be expanded to the height of the upper end H1UE of the inlet port H1. Therefore, the contact area between the heat exchange flow path part 126 and the heat exchange portion 1122B may increase, thereby improving the heat transfer efficiency. Therefore, the drying efficiency and energy efficiency may be improved.

In addition, a length by which the downstream end 126D of the heat exchange flow path part 126 vertically faces the upstream portion 1122A may increase. For example, the downstream end 126D of the heat exchange flow path part 126 may face the upstream portion 1122A vertically to the height of the upper end H1UE of the inlet port H1. Therefore, since the cold air discharged from the downstream end 126D of the heat exchange flow path part 126 may be in contact with the upstream portion 1122A vertically, the temperature in the upstream portion 1122A may be effectively decreased, and a large amount of condensate water may be produced and discharged to the outside. Therefore, the drying performance may be improved.

The downstream end 126D of the heat exchange flow path part 126 may be opened toward the portion of the upstream portion, which faces the inlet port H1 or extends in the vertically upward direction or the inclined upward direction.

That is, the downstream end 126D of the heat exchange flow path part 126 may be opened toward the inflow portion 1122A1 or the ascending duct portion 1122A2.

Therefore, the cold air flowing along the heat exchange flow path part 126 may cool not only the air flowing in the heat exchange portion 1122B, but also the air in the inflow portion 1122A1 or the ascending duct portion 1122A2. Therefore, the condensate water may be produced in the inflow portion 1122A1 or the ascending duct portion 1122A2 as well as the heat exchange portion 1122B and then discharged to the outside, which makes it possible to improve the drying performance. The condensate water produced in the inflow portion 1122A1 or the ascending duct portion 1122A2 may fall or flow downward by its own weight and then be easily discharged to the outside through the inlet port H1, for example.

[Second Condensing Duct]

Figure 14:
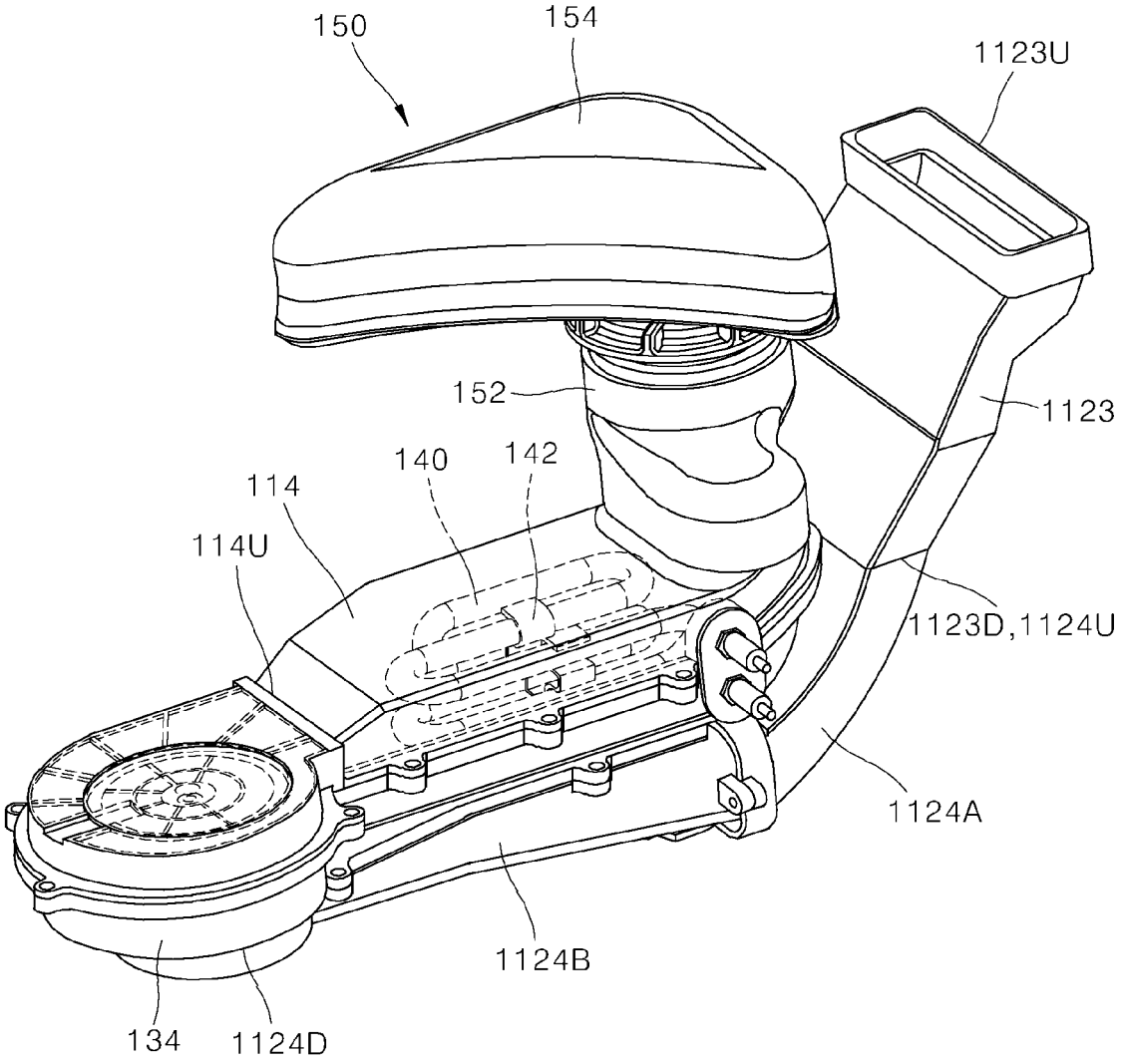
FIG. 14 is a perspective view illustrating a second connection duct, a second condensing duct, a return duct, a fan housing, a heater, a distributor, and a thermal conductor according to the embodiment of the present disclosure.
Figure 15:
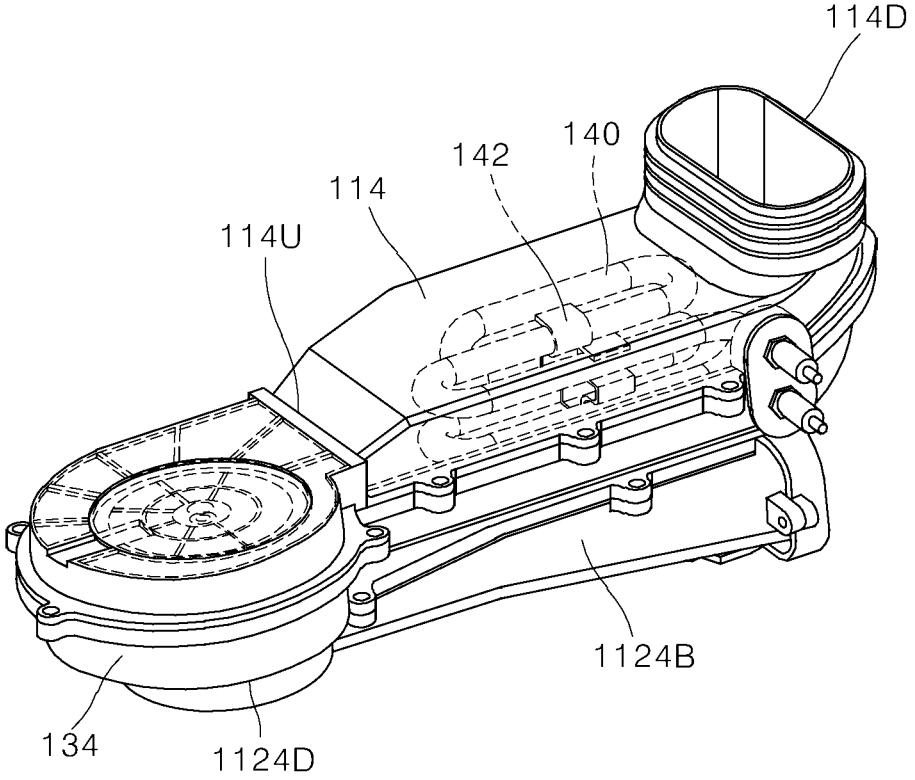
FIGS. 15 to 17 are a perspective view, a top plan view, and a cross-sectional view illustrating a downstream duct portion, the return duct, the fan housing, the heater, and the thermal conductor according to the embodiment of the present disclosure.
Figure 16:
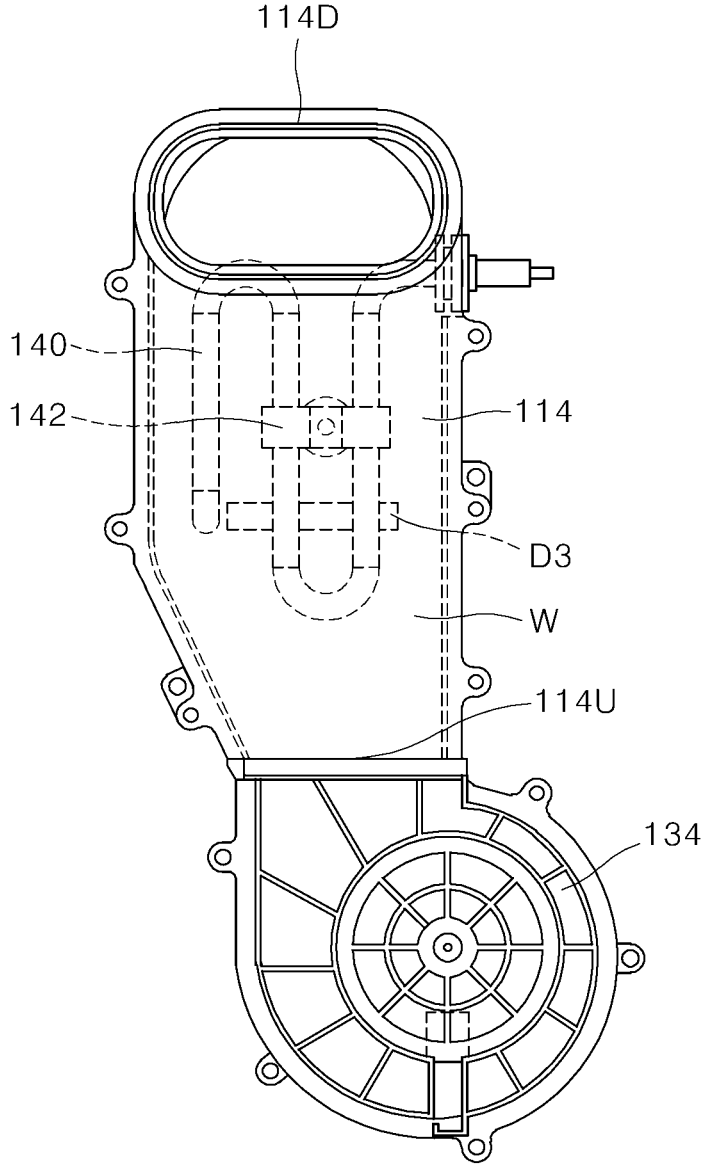
Figure 17:
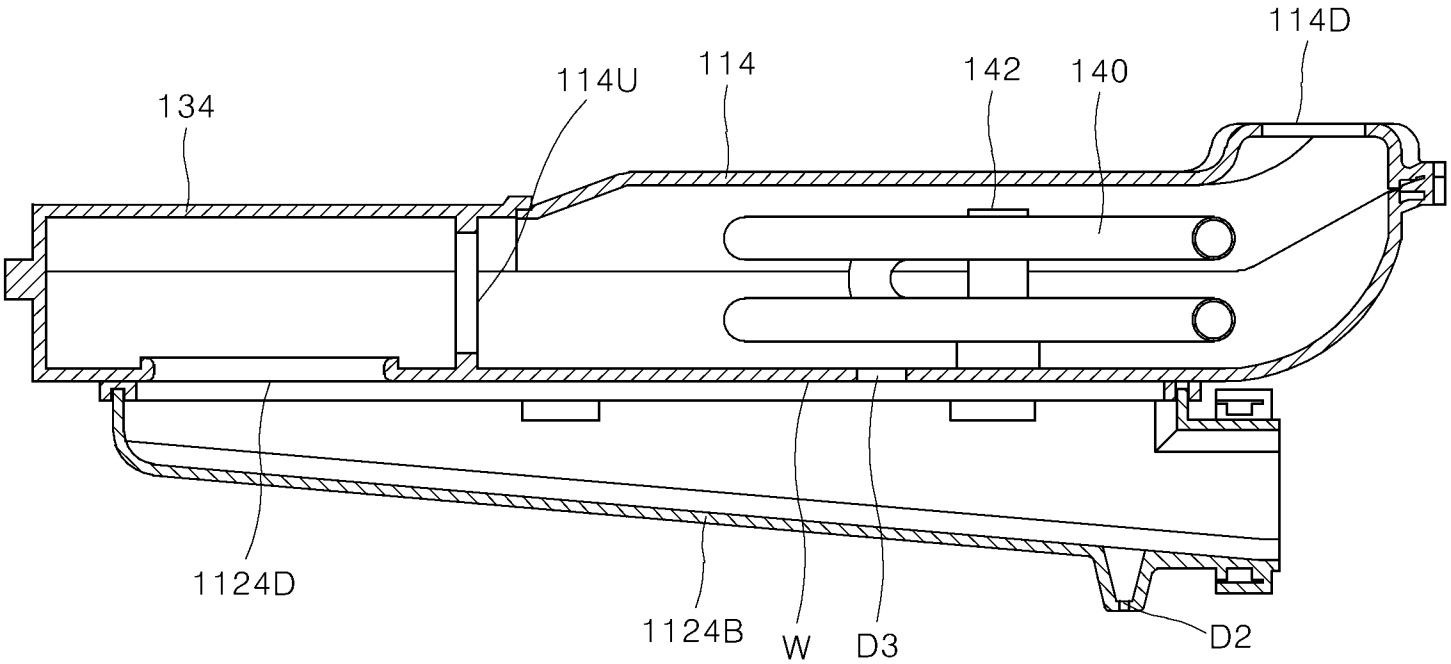
Figure 18:
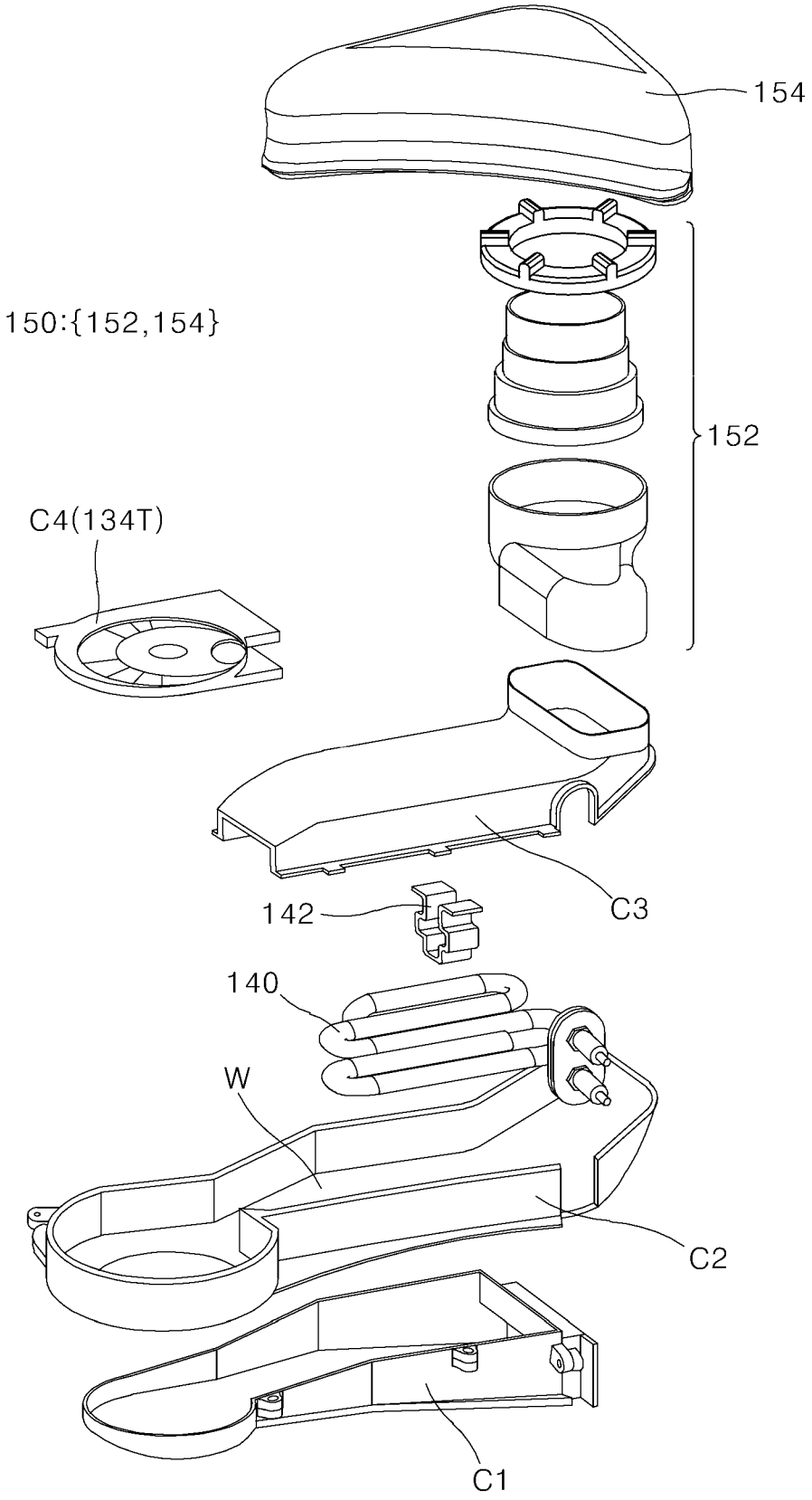
FIG. 18 is an exploded perspective view illustrating the downstream duct portion, the return duct, the fan housing, the heater, the distributor, and the thermal conductor according to the embodiment of the present disclosure.
Figure 19:
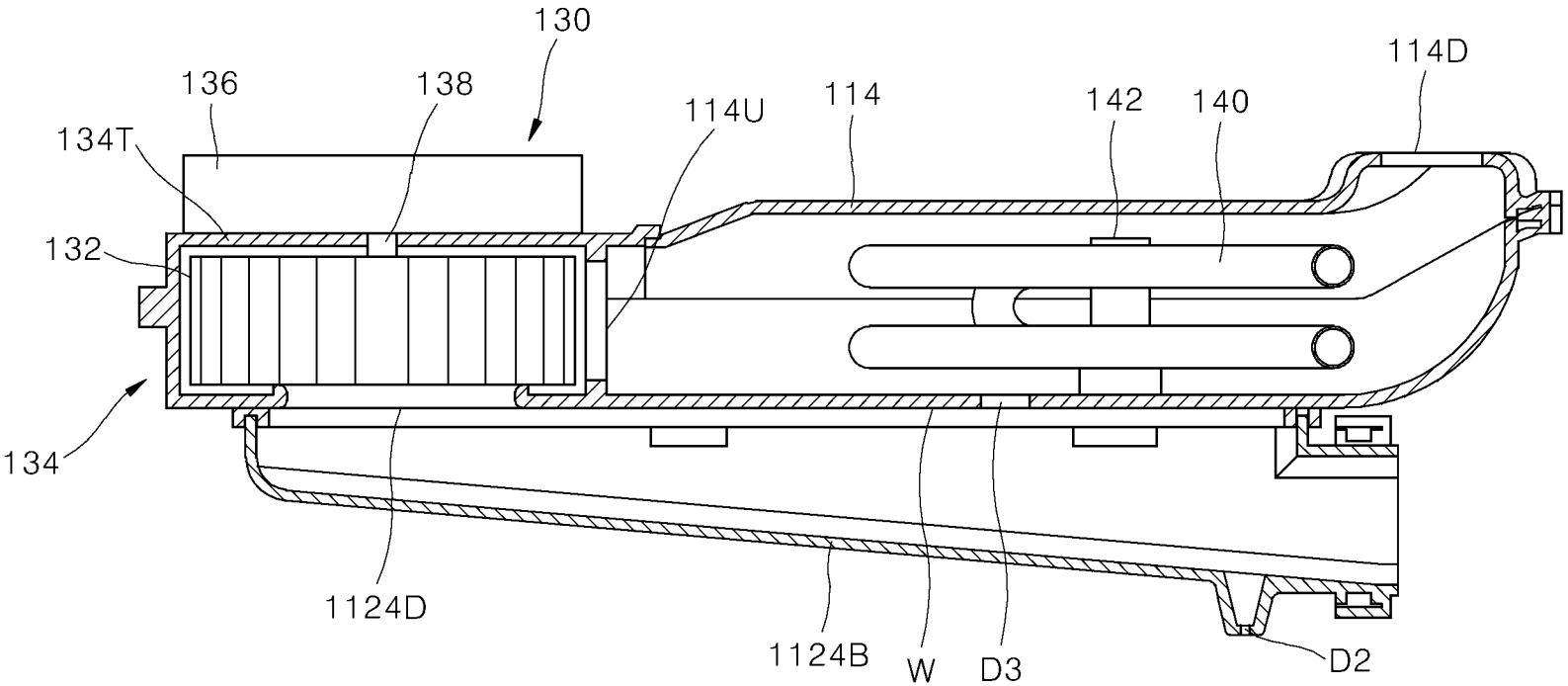
FIG. 19 is a cross-sectional view illustrating a state in which a fan blade and a motor are installed in the fan housing illustrated in FIG. 17.

FIG. 14 is a perspective view illustrating the a second connection duct, the second condensing duct, the return duct, a fan housing, the heater, and the distributor according to the embodiment of the present disclosure, and FIGS. 15 to 17 are a perspective view, a top plan view, and a cross-sectional view illustrating a downstream duct portion, the return duct, the fan housing, and the heater according to the embodiment of the present disclosure. FIG. 18 is an exploded perspective view illustrating the downstream duct portion, the return duct, the fan housing, the heater, and the distributor according to the embodiment of the present disclosure. FIG. 19 is a cross-sectional view illustrating a state in which a fan blade and a motor are installed in the fan housing illustrated in FIG. 17.

Further referring to FIGS. 14 to 19, the second condensing duct 1124 may be disposed lower than the bottom 12B of the tub 12. An upstream end 1124U of the second condensing duct 1124 may communicate with the downstream end 1122D of the first condensing duct 1122 (FIGS. 5 and 7).

Therefore, the condensing duct 112 adjoins the low-temperature air lower than the bottom 12B of the tub 12, such that the moisture vapor contained in the air flowing along the condensing duct 112 is condensed into water and then removed. Therefore, the drying performance may be improved by the simple structure and at low cost.

Specifically, for example, the second condensing duct 1124 may include an upstream duct portion 1124A and a downstream duct portion 1124B sequentially disposed along the flow direction of the air (FIGS. 7 and 14). The upstream duct portion 1124A and the downstream duct portion 1124B may be two duct sections of the second condensing duct 1124.

The upstream duct portion 1124A may communicate with the downstream end 1122D of the first condensing duct 1122 (FIGS. 5, 7, and 14). The upstream duct portion 1124A may be inclined approximately downward along the flow direction of the air.

The downstream duct portion 1124B may communicate with the return duct 114. The downstream duct portion 1124B may be approximately parallel to the horizontal plane or inclined upward along the flow direction of the air.

However, the present disclosure is not limited to this configuration. For example, the second condensing duct 1124 may be configured to include only a section parallel to the horizontal plane or inclined upward like the downstream duct portion 1124B. In this case, the downstream duct portion 1124B may be the second condensing duct 1124.

The second condensing duct 1124 may be bent in the vicinity of a downstream end 1124D and extend in an approximately vertical direction (e.g., upward). Therefore, it is possible to prevent the water, which is introduced into the second condensing duct 1124 or produced in the second condensing duct 1124, from being introduced into the return duct 114.

The horizontal straight distance d1 between the upstream end 1124U and the downstream end 1124D of the second condensing duct 1124 may be longer than a horizontal straight distance d2 between the upstream end 1124U of the second condensing duct 1124 and the outlet port H2 (FIG. 6). For example, in the second direction, the downstream end 1124D of the second condensing duct 1124 may be located beyond a midpoint of the bottom 12B of the tub 12 (FIG. 6).

Therefore, even though the outlet port H2 is formed in the vicinity of the inlet port H1 in the horizontal direction to improve the drying performance, a horizontal length of the return duct 114 communicating with the outlet port H2 and the downstream end 1124D of the second condensing duct 1124 may increase, and a distance between and the downstream end 1124D of the second condensing duct 1124 and the upstream end 114U of the return duct 114 may increase. Therefore, a heater 350 having a sufficiently large size may be disposed inside or outside the return duct 114, and the fan 130 may be disposed between the downstream end 1124D of the second condensing duct 1124 and the upstream end 114U of the return duct 114. Therefore, the drying performance of the dishwasher 1 may be improved by the simple configuration, and the dishwasher 1 may have a compact structure having a small size.

As described above, the downstream end 1122D of the first condensing duct 1122 may be positioned in the vicinity of the lower end of the rear portion of one sidewall 12R of the tub 12, and the upstream end 1124U of the second condensing duct 1124 may be positioned in the vicinity of one side end of the rear portion of the bottom 12B of the tub 12 (FIGS. 3, 5, and 7). For example, the downstream end 1122D of the first condensing duct 1122 may be positioned adjacent to the rear lower portion R13 of one sidewall 12R of the tub 12 and the upstream end 1124U of the second condensing duct 1124 may be positioned adjacent to the one rear side portion B11 of bottom 12B of the tub 12. For example, the downstream end 1122D of the first condensing duct 1122 may be positioned closest to rear lower portion R13 among the nine regions R11 to R33 of one sidewall 12R of the tub 12 (FIG. 2 or 3), thereby being positioned in the vicinity of the lower end of the rear portion of one sidewall 12R. And the upstream end 1124U of the second condensing duct 1124 may be positioned closest to one rear side portion B11 among the nine regions B11 to B33 of bottom 12B of the tub 12 (FIG. 2 or 3), thereby being positioned in the vicinity of one side end of the rear portion of bottom 12B. Therefore, since both the downstream end 1122D of the first condensing duct 1122 and the upstream end 1124U of the second condensing duct 1124 are positioned at the rear side together with the inlet port H1 and the outlet port H2, the condensing duct 112 may be formed in a shape similar to a straight line, and the length of the condensing duct 112 may decrease. Therefore, the flow resistance may be reduced, and the drying performance may be improved.

The second condensing duct 1124 may have a second water drain port D2 (FIG. 17). Therefore, the water introduced through the inlet port H1 or the outlet port H2 or the water condensed in the condensing duct 112 may be discharged to the outside through the second water drain port D2, thereby improving the drying performance of the drying device 100.

Meanwhile, a second connection duct 1123 may be disposed between the first condensing duct 1122 and the second condensing duct 1124. The second connection duct 1123 may communicate with the downstream end 1122D of the first condensing duct 1122 and the upstream end 1124U of the second condensing duct 1124 (FIGS. 5 and 7).

As described above, the condensing duct 112 includes: the first condensing duct 1122 facing the outer surface of one sidewall 12R of the tub 12 and having the upstream end communicating with the inlet port H1; and the second condensing duct 1124 disposed lower than the bottom 12B of the tub 12 and having the upstream end communicating with the downstream end of the first condensing duct 1122. Therefore the condensing duct 112 adjoins the low-temperature air outside of one sidewall 12R of the tub 12 and lower than the bottom 12B of the tub 12 such that the moisture vapor contained in the air flowing along the condensing duct 112 is condensed into water and removed. Therefore, the drying performance may be improved by the simple structure and at low cost.

[Return Duct]

The upstream end 114U of the return duct 114 may communicate with the downstream end 1124D of the second condensing duct 1124, and a downstream end 114D of the return duct 114 may communicate with the outlet port H2.

For example, the downstream end 114D of the return duct 114 may communicate with the distributor 150 that is inserted into the washing space 12S through the outlet port H2 and discharges the air into the washing space 12S.

The second condensing duct 1124 and the return duct 114 may be positioned only under rear portions B11, B12, and B13 of the bottom 12B of the tub 12. Therefore, since the second condensing duct 1124 and the return duct 114 are positioned at the rear side together with the outlet port H2 and the inlet port H1, the second condensing duct 1124 and the return duct 114 may be formed in a shape similar to a straight line, and the lengths of the ducts 1124, and 114 may decrease. Therefore, the flow resistance may be reduced, and the drying performance may be improved. In addition, the dishwasher 1 may have a compact structure having a small size.

The return duct 114 may be positioned between the bottom 12B of the tub 12 and the second condensing duct 1124. For example, at least a part of the return duct 114 may be disposed under the bottom 12B of the tub 12, and the part of the return duct 114 and the second condensing duct 1124 may be disposed vertically.

That is, at least a part of the return duct 114 may be disposed higher than the second condensing duct 1124.

Therefore, it is possible to prevent the water introduced into the second condensing duct 1124 through the inlet port H1 and the water condensed in the condensing duct 112 from being introduced into the return duct 114. Therefore, it is possible to prevent the water in the condensing duct 112 from being introduced into the washing space 12S through the outlet port H2 communicating with the return duct 114, thereby improving the drying performance. That is, the drying performance may be improved by preventing the water from flowing reversely.

The return duct 114 and the second condensing duct 1124 may at least partially adjoin each other in the longitudinal direction of the return duct 114 and the second condensing duct 1124. At the portion where the return duct 114 and the second condensing duct 1124 adjoin each other, the return duct 114 and the second condensing duct 1124 may be separated by a separation wall W disposed in the longitudinal direction of the return duct 114 and the second condensing duct 1124 (FIGS. 16 to 19).

Therefore, the return duct 114 and the second condensing duct 1124 may be easily manufactured by the simple configuration and at low cost. In addition, since the return duct 114 and the second condensing duct 1124 are separated by the single separation wall W, apart of heat generated from the heater 140 disposed in the return duct 114 may be easily transferred to the second condensing duct 1124. Therefore, a small amount of water in the second condensing duct 1124 is vaporized by the heat transferred to the second condensing duct 1124, and thus the humidity in the second condensing duct 1124 decreases, which makes it possible to prevent the proliferation of bacteria or mold in the second condensing duct 1124.

The return duct 114 may have a third water drain port D3 (FIG. 17). Therefore, the water introduced through the outlet port H2 and the water condensed in the return duct 114 may be discharged to the outside of the return duct 114 through the third water drain port D3, thereby improving the drying performance of the drying device 100. In this case, the outside of the return duct 114 may be the inside of the second condensing duct 1124 (FIG. 17).

[Fan]

The fan 130 may be disposed between the downstream end 1124D of the condensing duct 112 and the downstream end 114D of the return duct 114. For example, the fan 130 may be disposed between the second condensing duct 1124 and the return duct 114.

Therefore, the fan 130 may prevent the occurrence of vortex and allow the air to smoothly flow in a downstream portion (e.g., between the condensing duct and the return duct) of the drying duct 110 where the flow direction of the air is considerably changed. Therefore, flow resistance is not increased, which makes it possible to improve the drying performance of the drying device 100.

The fan 130 may communicate with the second condensing duct 1124 (FIG. 19). For example, the fan 130 may communicate downwardly with the downstream end 1124D of the second condensing duct 1124.

In addition, the fan 130 may communicate with the return duct 114 (FIG. 19). For example, the fan 130 may communicate laterally with the upstream end 114U of the return duct 114.

The fan 130 may be disposed higher than the downstream end 1124D of the second condensing duct 1124 (FIG. 19).

Therefore, it is possible to prevent a motor 136 of the fan 130 from coming into contact with the water introduced into the condensing duct 112 or the water condensed in the condensing duct 112. Therefore, it is possible to prevent the water from being introduced into the motor 136 of the fan 130 and thus prevent the fan 130 from being broken down, thereby improving the durability and stability of the drying device 100.

The fan 130 may allow the air to flow in the drying duct 110. Specifically, for example, the fan 130 may introduce the air in the first condensing duct 1122 into the second condensing duct 1124. In addition, the fan 130 may introduce the air in the second condensing duct 1124 into the return duct 114. In addition, the fan 130 may discharge the air in the return duct 114 into the washing space 12S through the outlet port H2 and the distributor 150 to be described below.

The fan 130 may include a fan blade 132, a fan housing 134, and the motor 136.

The fan blade 132 may be fixedly coupled to a rotary shaft 138 and rotated by the motor 136. The fan blade 132 may be accommodated in the fan housing 134.

The fan housing 134 may communicate with the downstream end 1124D of the second condensing duct 1124 and the upstream end 114U of the return duct 114.

For example, the fan housing 134 may have a through-hole formed in a lower surface thereof and communicate downwardly with the downstream end 1124D of the second condensing duct 1124 (FIG. 19). In addition, the fan housing 134 may have a through-hole formed in a lateral surface thereof and communicate laterally with the upstream end 114U of the return duct 114 (FIG. 19).

The fan housing 134 may include an upper wall 134T. The upper wall 134T may be disposed between the fan blade 132 and the motor 136 disposed above the fan blade 132.

Therefore, even though the fan blade 132 comes into contact with the water introduced into the return duct 114 through the outlet port H2, the water being in contact with the fan blade 132 is blocked by the upper wall 134T, such that the water cannot come into contact with the motor 136. Therefore, it is possible to prevent the water from being introduced into the motor 136 and thus prevent the fan 130 from being broken down, thereby improving the durability and stability of the drying device 100.

The upper wall 134T may have a hole penetrated by the rotary shaft 138.

The motor 136 may be coupled to the fan blade 132 by means of the rotary shaft 138. The motor 136 may rotate the fan blade 132.

The motor 136 may be disposed above the fan blade 132. In addition, the motor 136 may be disposed on the upper wall 134T.

The rotary shaft 138 of the fan 130 may extend in an approximately vertical direction.

Therefore, the fan 130 may be installed to be laid between the second condensing duct 1124 and the return duct 114. Therefore, the fan 130 having a sufficiently large size may be installed even though the installation space or the installation position is restricted. Therefore, the drying performance of the dishwasher 1 may be improved by the simple configuration and at low cost, and the dishwasher 1 may have a compact structure having a small size. In this case, the fan 130 may be a centrifugal fan. In addition, since the motor 136 may be disposed above the fan blade 132, it is possible to prevent the water from being introduced into the motor 136.

[Heater]

The heater 140 may be disposed between the downstream end 1124D of the condensing duct 112 and the downstream end 114D of the return duct 114. For example, the heater 140 may be disposed in the return duct 114.

Therefore, the heater 140 may heat the air in the downstream portion (e.g., the return duct) of the drying duct 110 close to the outlet port H2 and discharge the high-temperature dry air into the washing space 12S, thereby improving the drying performance by the simple configuration and at low cost.

The heater 140 may be disposed in the return duct 114 (FIGS. 14 to 19). However, the present disclosure is not limited to this configuration. For example, unlike the drawings, the heater 140 may be provided adjacent to the return duct 114 and disposed outside the return duct 114.

Since the heater 140 is disposed in the return duct 114 as described above, the air may be effectively heated in the return duct 114 close to the outlet port H2. Therefore, the heated air flowing into the washing space 12S may effectively remove moisture remaining on dishes in the washing space 12S. Therefore, the drying performance may be improved by the simple structure and at low cost.

In addition, since the heater 140 is disposed in the return duct 114, the heater 140 is positioned to be distant from the water introduced into the condensing duct 112 or the water condensed in the condensing duct 112 without coming into contact with the water. Therefore, it is possible to prevent the heat generated by the heater 140 from vaporizing a large amount of water collected in the condensing duct 112. Therefore, the high-temperature dry air in the return duct 114 may flow into the washing space 12S, thereby improving the drying performance.

The heater 140 may heat the air in the drying duct 110.

As described above, the drying device 100 includes the drying duct 110, the fan 130, and the heater 140, and the drying duct 110 is disposed outside the tub 12 and includes the condensing duct 112 and the return duct 114, which makes it possible to improve the drying performance by the simple configuration and at low cost.

[Distributor]

As illustrated in FIG. 18, the distributor 150 may include an insertion part 152 and a lid 154.

A lower end of the insertion part 152 may communicate with the downstream end 114D of the return duct 114, and an upper end of the insertion part 152 may be coupled to the lid 154. The insertion part 152 may be installed to penetrate the outlet port H2 formed in the bottom 12B of the tub 12.

The air heated in the return duct 114 may flow into the washing space 12S through the insertion part 152.

The lid 154 may be installed at an upper end of the insertion part 152 and disposed in the washing space 12S.

The lid 154 may prevent the water in the washing space 12S from being introduced into the insertion part 152 and the return duct 114.

In addition, the lid 154 may prevent the air flowing out of the insertion part 152 from flowing upward in the vertical direction when the air is introduced into the washing space 12S. Therefore, since the condition i) is satisfied, the dry air introduced into the washing space 12S through the outlet port H2 may effectively circulate everywhere in the washing space 12S until the dry air is introduced into the drying device 100 through the inlet port H1, thereby improving the drying efficiency.

Meanwhile, the downstream duct portion 1124B, the fan housing 134, and the return duct 114 illustrated in FIGS. 15 to 17 may include a first housing C1, a second housing C2, a third housing C3, and a fourth housing C4, as illustrated in FIG. 18.

The first housing C1 may be disposed at the lower side and opened upward.

The second housing C2 may be disposed on the first housing C1 and coupled to the first housing C1.

The third housing C3 may be opened downward, disposed on the second housing C2, and coupled to the second housing C2.

The fourth housing C4 may be disposed one end of the second housing C2 and coupled to the second housing C2.

The downstream duct portion 1124B may be defined by the first housing C1 and the second housing C2, and the return duct 114 may be defined by the second housing C2 and the third housing C3. The separation wall W may be the bottom of the second housing C2.

The fan housing 134 may be defined by one end of the second housing C2 and the fourth housing C4. That is, a part of the fan housing 134 (one end of the second housing) may be integrated with a part of the return duct 114 (the remaining part of the second housing). The fourth housing C4 may be the upper wall 134T of the fan housing 134.

The second water drain port D2 may be formed in the bottom of the first housing C1, and the third water drain port D3 may be formed in the bottom of the second housing C2.

The heater 140 may be disposed in the internal space defined by coupling the second housing C2 and the third housing C3. In this case, a fixing part 142, which has high heat resistance and low thermal conductivity, may be fixed to the second housing C2 or the third housing C3, and the heater 140 may be installed by being coupled to the fixing part 142. Therefore, it is possible to prevent the second housing C2 or the third housing C3 from being damaged by the heater 140.

As described above, the downstream duct portion 1124B, the fan housing 134, and the return duct 114 may be configured by coupling the first housing C1, the second housing C2, the third housing C3, and the fourth housing C4. Therefore, the drying device 100 may be simply and easily manufactured and easily maintained. Further, the drying device 100 may have a compact structure having a small size.

Meanwhile, for convenience, the configuration has been described in which the drying duct 110 is divided into the condensing duct 112 and the return duct 114. However, the condensing duct 112 and the return duct 114 may be integrated.

The first condensing duct 1122 and the second condensing duct 1124 may also be integrated.

The ducts 110, 112, 1122, 1124, and 114 may each be made of a metallic material such as aluminum or stainless steel.

The ducts 110, 112, 1122, 1124, and 114 may be manufactured by steel metal working or injection molding.

Some components of the drying device 100, such as the fan 130, may be made of plastic.

While the present disclosure has been described above with reference to the accompanying drawings, the present disclosure is not limited to the drawings and the embodiments disclosed in the present specification, and it is apparent that the present disclosure may be variously changed by those skilled in the art without departing from the technical spirit of the present disclosure. Further, even though the operational effects of the configurations of the present disclosure have not been explicitly disclosed and described in the description of the embodiment of the present disclosure, the effects, which can be expected by the corresponding configurations, should, of course, be acceptable.

What is claimed is:

1. A dishwasher comprising:

a tub having a washing space defined therein;

a door disposed at a front side of the tub and configured to open and close at least a portion of the washing space; and a drying device configured to supply air to the washing space, the drying device comprising:

a condensing duct that is disposed outside the tub and faces an outer surface of the tub, the condensing duct being in fluid communication with an inlet port defined at the tub, a cold air supply module disposed outside the tub, the cold air supply module comprising a heat exchange flow path part that is spaced apart from the inlet port, that comprises a pair of plates parallel to a side surface of the tub, and that overlaps with at least a portion of the condensing duct, and a fan configured to cause a flow of air in the condensing duct, wherein the condensing duct comprises:

an upstream portion that is in fluid communication with the inlet port, the upstream portion being curved upward relative to the inlet port and extending downward from an upper end of the upstream portion, and a heat exchange portion that is connected to the upstream portion, that is disposed between the pair of plates, and that extends downward from the upstream portion along the pair of plates, the heat exchange portion facing and overlapping with the pair of plates, wherein the condensing duct further comprises one or more guides that are disposed at the upstream portion and extend along the upstream portion, and the one or more guides protrude from the condensing duct in a direction toward the side surface of the tub, wherein the one or more guides comprise a plurality of guides extending between an upper edge of the heat exchange flow path part and the inlet port and disposed at the upstream portion and spaced apart from one another, wherein the plurality of guides comprise a first guide and a second guide that extend from an upper edge of the heat exchange flow path part, the second guide being spaced apart from the first guide and disposed vertically above the first guide, and wherein a length of the second guide from the upper edge of the heat exchange flow path part to an upstream end of the second guide is greater than a length of the first guide from the upper edge of the heat exchange flow path part to an upstream end of the first guide.

2. The dishwasher of claim 1, wherein a portion of the upstream portion of the condensing duct faces the inlet port and extends in an upward direction relative to the inlet port or in an inclined direction with respect to the upward direction, and wherein a downstream end of the heat exchange flow path part is open toward the portion of the upstream portion of the condensing duct.

3. The dishwasher of claim 1, wherein a height of an upper end of the heat exchange flow path part is greater than or equal to a height of a lower end of the inlet port, and wherein the height of the upper end of the heat exchange flow path part is less than or equal to a height of an upper end of the inlet port.

4. The dishwasher of claim 1, wherein a cross-sectional area of a downstream end of the upstream portion is greater than a cross-sectional area of a portion of the upstream portion disposed at a height of an upper end of the inlet port.

5. The dishwasher of claim 1, wherein the upstream portion has an inner surface that is curved and that defines a concave portion, and wherein a horizontal width of the concave portion decreases toward an upper end of the inner surface of the upstream portion.

6. The dishwasher of claim 1, wherein the upstream portion has an inner surface that is curved and that defines a concave portion, and wherein a horizontal width of the concave portion is maintained toward an upper end of the inner surface of the upstream portion.

7. The dishwasher of claim 1, wherein the upstream portion comprises:

an inflow portion that faces the inlet port and extends upward to a height of an upper end of the inlet port, the inflow portion being opened upward relative to the inlet port;

an ascending duct portion that extends from an upper end of the inflow portion (i) in an upward direction relative to the inflow portion or (ii) in an ascending inclined direction with respect to the upward direction; and a descending duct portion having an upstream end in fluid communication with a downstream end of the ascending duct portion and a downstream end in fluid communication with the heat exchange portion, the descending duct portion extending (i) in a downward direction relative to the ascending duct portion or (ii) in a descending inclined direction with respect to the downward direction.

8. The dishwasher of claim 7, wherein no part of the ascending duct portion extends toward a region in which the condensing duct and the outer surface of the tub face each other.

9. The dishwasher of claim 7, wherein a cross-sectional area of a section of the inflow portion increases toward the ascending duct portion.

10. The dishwasher of claim 9, wherein at least a part of the section of the inflow portion protrudes outward relative to an end of the inlet port.

11. The dishwasher of claim 1, wherein an upstream end of the heat exchange portion is connected to a downstream end of the upstream portion of the condensing duct, wherein the upstream portion of the condensing duct has a first pair of opposite surfaces that face each other in a horizontal direction and that are disposed at the downstream end of the upstream portion, wherein the heat exchange portion has a second pair of opposite surfaces that face each other in the horizontal direction and that are disposed at the upstream end of the heat exchange portion, and wherein orientations of the first pair of opposite surfaces correspond to orientations of the second pair of opposite surfaces, respectively.

12. The dishwasher of claim 1, wherein the one or more guides comprise a vane.

13. The dishwasher of claim 1, wherein a curvature of the upstream end of the second guide is greater than a curvature of the upstream end of the first guide.

14. The dishwasher of claim 1, wherein the one or more guides define a slit.

15. The dishwasher of claim 14, wherein the slit is inclined downward and open toward the inlet port.

16. The dishwasher of claim 1, wherein the plurality of guides define a plurality of slits, respectively, wherein the plurality of guides are spaced apart from a vertical extension line extending from a center of the inlet port and comprise:

a first guide that defines a first slit among the plurality of slits, and a second guide that is spaced apart from the first guide and disposed vertically above the first guide, the second guide defining a second slit among the plurality of slits, and wherein a horizontal distance from the vertical extension line to the second slit is greater than a horizontal distance from the vertical extension line to the first slit.

17. The dishwasher of claim 16, wherein the upstream portion of the condensing duct has an inner surface that is curved, and wherein a lowermost slit among the plurality of slits is positioned vertically above an upper end of the inner surface of the upstream portion in an upward direction, or the lowermost slit is offset toward the inlet port with respect to the upper end of the inner surface of the upstream portion.

18. The dishwasher of claim 17, wherein a horizontal distance from the vertical extension line to the lowermost slit is less than or equal to a horizontal distance from the vertical extension line to the upper end of the inner surface of the upstream portion.

19. The dishwasher of claim 1, wherein the plurality of guides include a first guide comprising a first slit defined in the first guide and configured to allow condensate water to penetrate the first guide through the first slit and flow downward to a second guide of the plurality of guides or an inner surface of the upstream portion.

20. A dishwasher comprising:

a tub having a washing space defined therein;

a door disposed at a front side of the tub and configured to open and close at least a portion of the washing space; and a drying device configured to supply air to the washing space, the drying device comprising:

a condensing duct that is disposed outside the tub and faces an outer surface of the tub, the condensing duct being in fluid communication with an inlet port defined at the tub, a cold air supply module disposed outside the tub, the cold air supply module comprising a heat exchange flow path part that is spaced apart from the inlet port, that comprises a pair of plates parallel to a side surface of the tub, and that overlaps with at least a portion of the condensing duct, and a fan configured to cause a flow of air in the condensing duct, wherein the condensing duct comprises:

an upstream portion that is in fluid communication with the inlet port, the upstream portion being curved upward relative to the inlet port and extending downward from an upper end of the upstream portion, and a heat exchange portion that is connected to the upstream portion, that is disposed between the pair of plates, and that extends downward from the upstream portion along the pair of plates, the heat exchange portion facing and overlapping with the pair of plates, wherein the condensing duct further comprises one or more guides that are disposed at the upstream portion and extend along the upstream portion, and the one or more guides protrude from the condensing duct in a direction toward the side surface of the tub, wherein the one or more guides comprise a plurality of guides extending between an upper edge of the heat exchange flow path part and the inlet port and disposed at the upstream portion and spaced apart from one another, wherein the plurality of guides define a plurality of slits, respectively, wherein the plurality of guides are spaced apart from a vertical extension line extending from a center of the inlet port and comprise:

a first guide that defines a first slit among the plurality of slits, the first slit being formed in the first guide and configured to allow condensate water to penetrate the first guide through the first slit and flow downward, and a second guide that is spaced apart from the first guide and disposed vertically above the first guide, the second guide defining a second slit among the plurality of slits, the second slit being formed in the second guide and configured to allow condensate water to penetrate the second guide through the second slit and flow downward, and wherein a horizontal distance from the vertical extension line to the second slit is greater than a horizontal distance from the vertical extension line to the first slit.

* * * * *